US009409388B2

(12) United States Patent
Edamura et al.

(10) Patent No.: US 9,409,388 B2
(45) Date of Patent: Aug. 9, 2016

(54) APPARATUS AND METHOD OF INK-JET RECORDING AND NON-TRANSITORY COMPUTER-READABLE STORAGE MEDIUM

(71) Applicant: CANON KABUSHIKI KAISHA, Tokyo (JP)

(72) Inventors: Tetsuya Edamura, Inagi (JP); Masashi Hayashi, Yokohama (JP); Kazunori Yamauchi, Yokohama (JP); Tsukasa Doi, Kawasaki (JP); Daisuke Kobayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/831,212

(22) Filed: Aug. 20, 2015

(65) Prior Publication Data

US 2016/0052263 A1 Feb. 25, 2016

(30) Foreign Application Priority Data

Aug. 25, 2014 (JP) ..... 2014-170985

(51) Int. Cl.
*B41J 2/045* (2006.01)

(52) U.S. Cl.
CPC ..... *B41J 2/04551* (2013.01); *B41J 2/04568* (2013.01); *B41J 2/04513* (2013.01); *B41J 2/04515* (2013.01); *B41J 2/04536* (2013.01); *B41J 2/04545* (2013.01)

(58) Field of Classification Search
CPC .... B41J 2/0458; B41J 2/04563; B41J 29/393; B41J 2/04591; B41J 2/04581; B41J 2/04568; B41J 2/04551; B41J 2/04545; B41J 2/04515; B41J 2/04513
USPC ..... 347/14
See application file for complete search history.

(56) References Cited

U.S. PATENT DOCUMENTS 6,315,392 B1 * 11/2001 Kinas ..... B41J 2/2132 347/15
2007/0263022 A1 * 11/2007 Chigusa ..... B41J 2/17509 347/14

FOREIGN PATENT DOCUMENTS

JP 2006-326939 * 7/2006 ..... B41J 2/01
JP 2006-326939 A 12/2006

* cited by examiner

*Primary Examiner* — Manish S Shah
*Assistant Examiner* — Yaovi M Ameh
(74) *Attorney, Agent, or Firm* — Canon U.S.A., Inc. IP Division

(57) ABSTRACT

An apparatus and a method of recording in which an ink ejection failure due to an excessive rise in the temperature of ejection ports is prevented while preventing a decrease in throughput. If ink can run out and the amount of ink ejected to one unit area is large, recording on the unit area is performed with an increased number of scans.

16 Claims, 19 Drawing Sheets

| | STANDARD | HIGH |
|---|---|---|
| ORDINARY PAPER | ONE-PASS | FIVE-PASS |
| POSTCARD | TWO-PASS | FIVE-PASS |
| PHOTO PAPER | FIVE-PASS | SEVEN-PASS |

FIG. 10A1
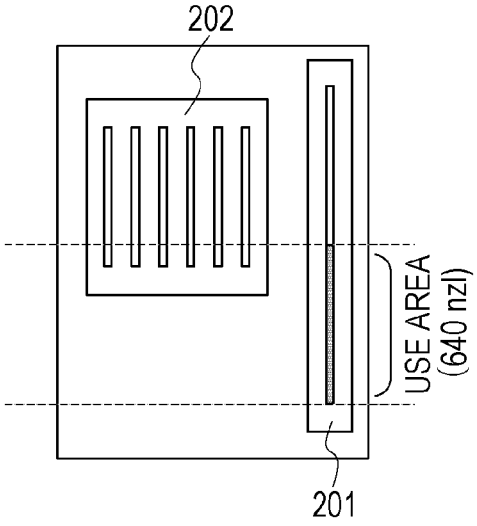
FIG. 10B1
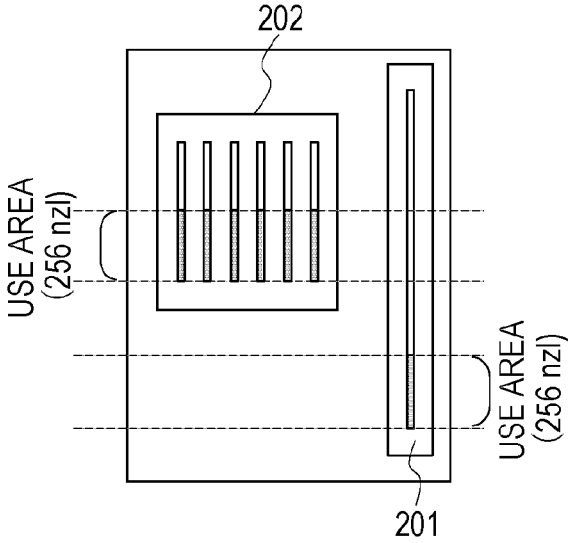
FIG. 10A2
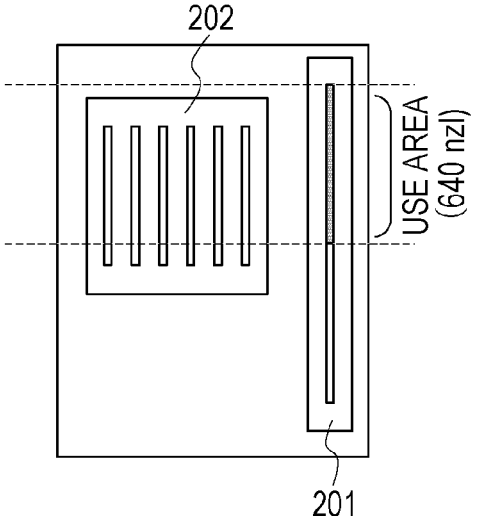
FIG. 10B2
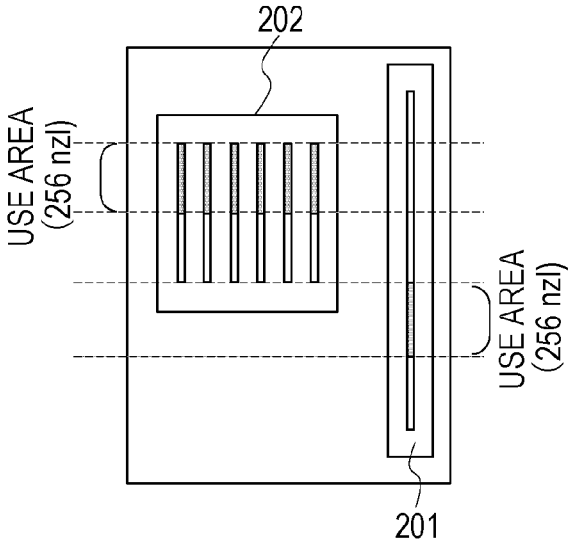

APPARATUS AND METHOD OF INK-JET RECORDING AND NON-TRANSITORY COMPUTER-READABLE STORAGE MEDIUM

BACKGROUND OF THE INVENTION

1. Field of the Invention

The present invention relates to an apparatus and a method of ink-jet recording, as well as a non-transitory computer-readable storage medium.

2. Description of the Related Art

Known ink-jet recording apparatuses record images on recording media by ejecting ink by driving a plurality of recording elements of a recording head for ejecting ink to supply thermal energy to the ink while causing the recording head to scan the recording medium.

In such ink-jet recording apparatuses, it is known that when the recording elements are driven in a state in which the ink level is low, so that channels to ejection ports at positions corresponding to the recording elements are not sufficiently supplied with ink, the recording head increases in temperature due to generated heat. Repeating such driving can excessively raise the temperature of the ejection ports, causing an ink ejection failure.

Another known apparatus has a function of detecting the ink level, in which if the ink level has become low, an low-ink error message is issued. Japanese Patent Laid-Open No. 2006-326939 discloses an apparatus and a method of recording in which when the ink level becomes lower than a predetermined threshold value, the number of scans on a unit area is increased.

However, the recording disclosed in the Japanese Patent Laid-Open No. 2006-326939 can result in low throughput.

SUMMARY OF THE INVENTION

The present invention provides an apparatus and a method of recording in which an ink ejection failure due to an excessive rise in the temperature of ejection ports is prevented while preventing a decrease in throughput.

An ink-jet recording apparatus according to an aspect of the present invention includes a recording head having a recording element array in which a plurality of recording elements that generate energy for use in ejecting ink are arrayed in a predetermined direction; a scanning unit configured to cause the recording head to scan a recording medium in a scanning direction intersecting the predetermined direction; a first acquisition unit configured to acquire information on a cumulative total of an ejection amount of ink; a second acquisition unit configured to acquire information on an ejection amount of ink during scanning for recording on a unit area of the recording medium; a selection unit configured to select one recording mode from a plurality of recording modes including at least a first recording mode and a second recording mode, the first recording mode being for recording an image on the unit area with M relative scans of the recording head performed by the scanning unit, and the second recording mode being for recording an image on the unit area with N (N>M) scans of the recording head performed by the scanning unit, with a limited number of recording elements driven among recording elements in a range of a length corresponding to the unit area of the recording element array in the predetermined direction so as to permit a smaller number of recording elements than recording elements permitted to be driven in the first recording mode during one scan of the recording head with the scanning unit; and a recording unit configured to record an image on the unit area by driving the plurality of recording elements according to a recording mode selected by the selection unit and ejecting ink from the recording head, wherein the selection unit (i) selects the first recording mode if the cumulative total indicated by the information acquired by the first acquisition unit is equal to or larger than a predetermined cumulative total, and the ejection amount indicated by the information acquired by the second acquisition unit is smaller than a first ejection amount; and (ii) selects the second recording mode if the cumulative total indicated by the information acquired by the first acquisition unit is equal to or larger than the predetermined threshold value, and the ejection amount indicated by the information acquired by the second acquisition unit is equal to or larger than the first ejection amount.

Further features of the present invention will become apparent from the following description of exemplary embodiments with reference to the attached drawings.

BRIEF DESCRIPTION OF THE DRAWINGS

FIG. 10A1 is a diagram illustrating a second recording operation according to an embodiment.

FIG. 10A2 is a diagram illustrating the second recording operation according to an embodiment.

FIG. 10B1 is a diagram illustrating the second recording operation according to an embodiment.

FIG. 10B2 is a diagram illustrating the second recording operation according to an embodiment.

DESCRIPTION OF THE EMBODIMENTS

A first embodiment of the present invention will be described in detail hereinbelow with reference to the drawings.

Figure 1:
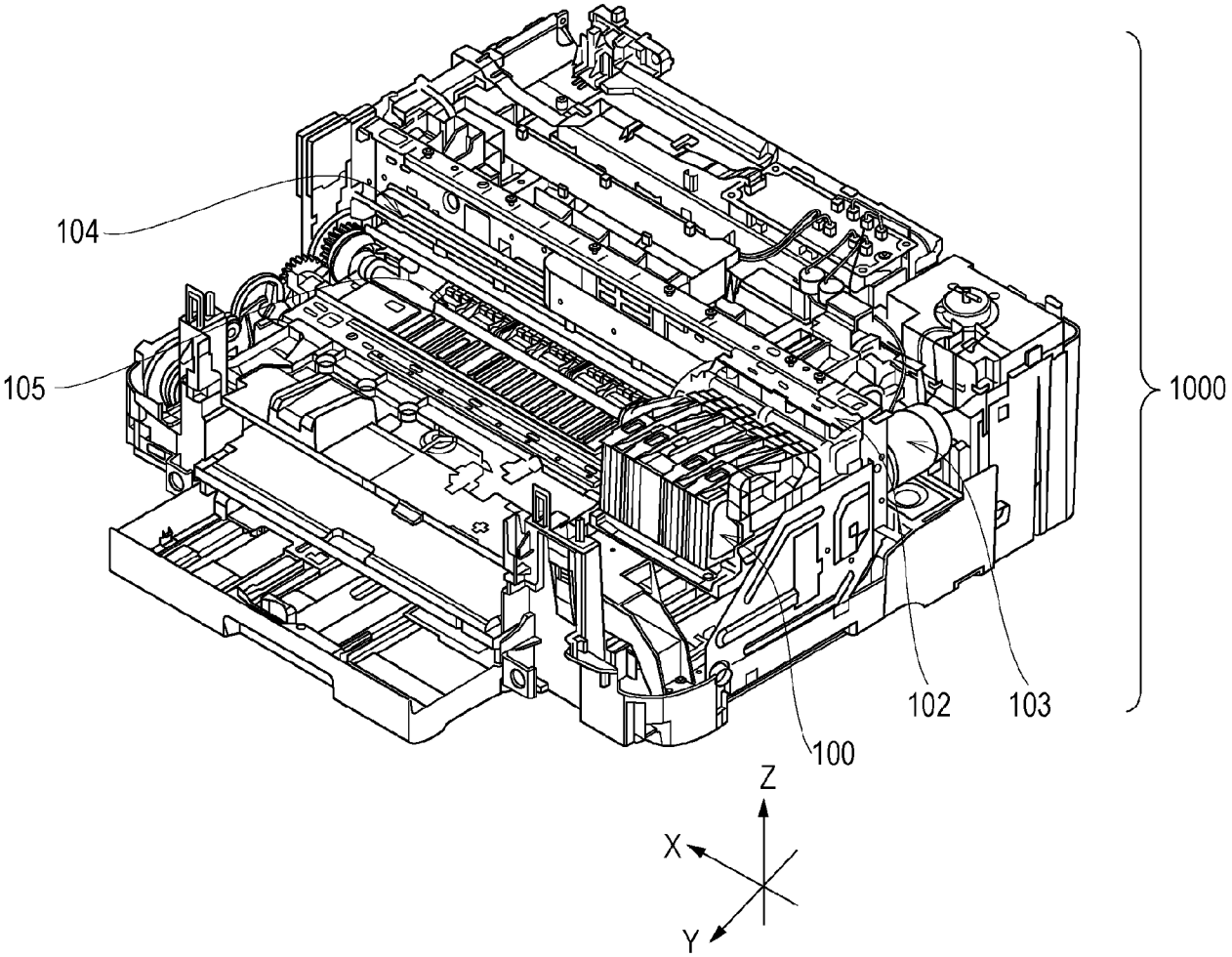
FIG. 1 is a perspective view of an ink-jet recording apparatus according to an embodiment.

FIG. 1 is a perspective view of part of the internal configuration of an ink-jet recording apparatus 1000 according to the first embodiment.

An interchangeable head cartridge 100 includes a recording head 101 (see FIG. 2) for ejecting ink, described later, and an ink tank for supplying ink to the recording head 101. The head cartridge 100 is detachably held by a carriage 102. The carriage 102 and the head cartridge 100 are moved in forward and backward directions along an X-direction (a scanning direction) by driving a carriage motor 103. At that time, a driving force from the carriage motor 103 is transmitted to the carriage 102 through a carriage belt 104. During the forward and backward scanning operations of the carriage 102, the recording head 101 ejects ink according to recording data, so that recording on a recording medium is performed (a recording operation). The recording medium is conveyed in a Y-direction (a conveying direction) crossing the X-direction by a predetermined amount by the conveying roller 105 while the recording operation is not performed (a conveying operation).

In this embodiment, such a recording operation and a conveying operation are alternately repeated to record an image on a recording medium with a plurality of scans.

Figure 2:
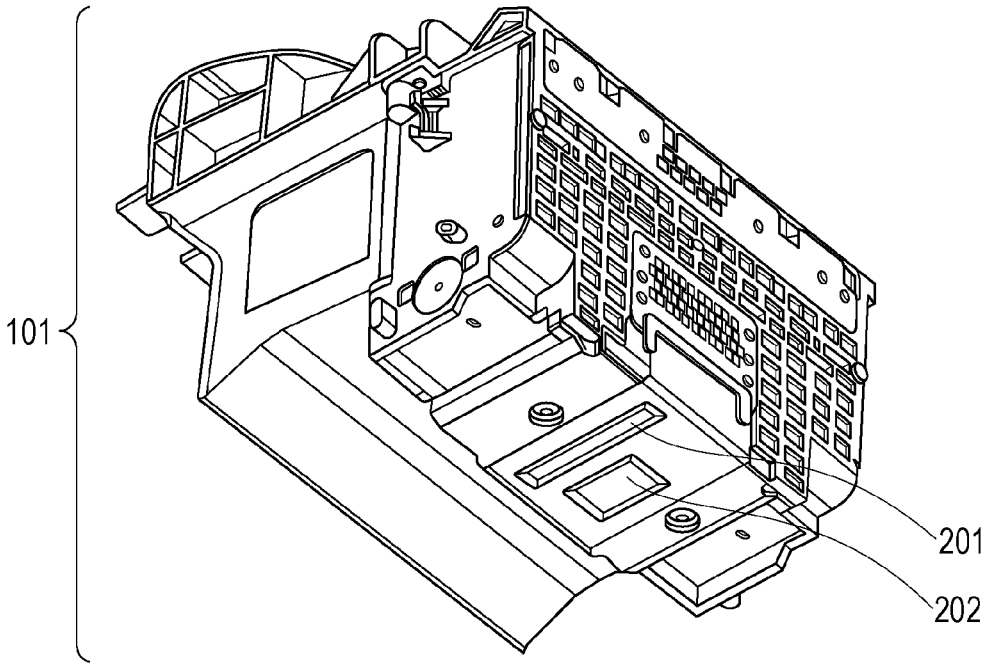
FIG. 2 is a perspective view of a recording head according to an embodiment.
Figure 3A:
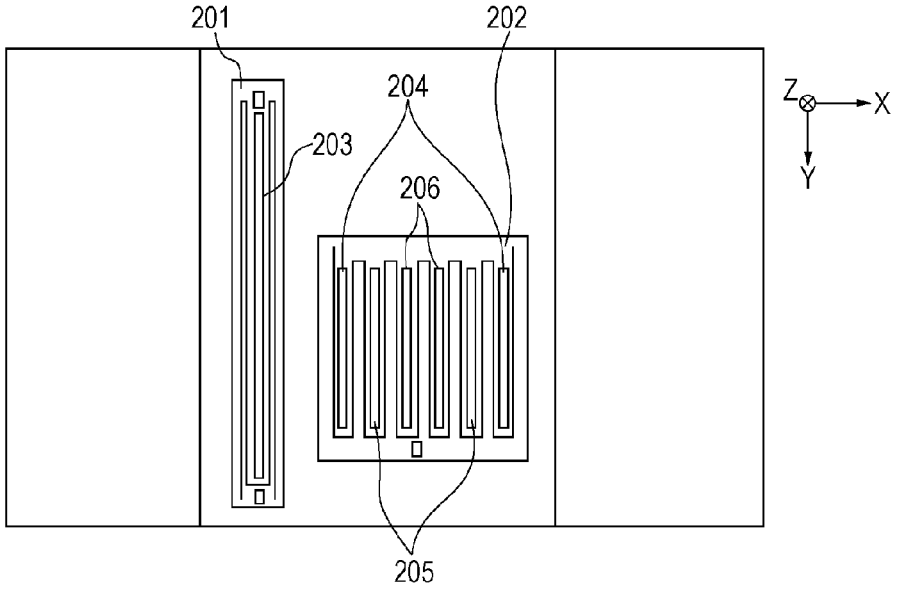
FIG. 3A is an enlarged diagram of the recording head according to an embodiment.
Figure 3B:
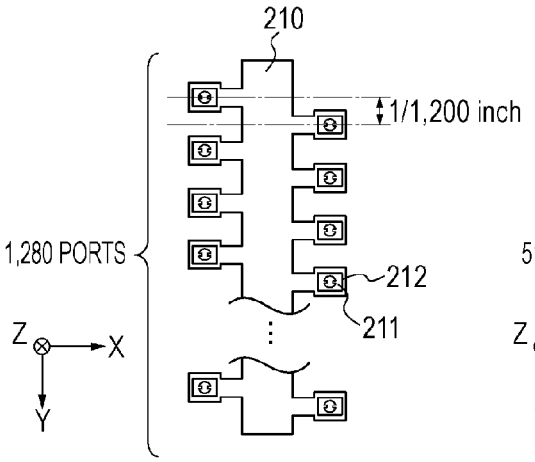
FIG. 3B is an enlarged diagram of a Bk ejection port array according to an embodiment.
Figure 3C:
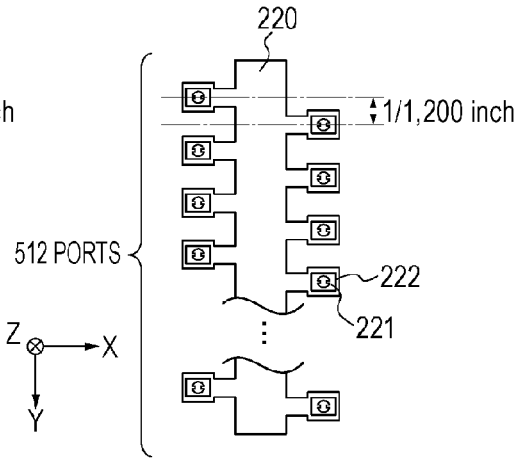
FIG. 3C is an enlarged diagram of a Cl ejection port array according to an embodiment.

FIG. 2 is a perspective view of the recording head 101 according to this embodiment. FIGS. 3A to 3C are enlarged diagrams of chips 201 and 202 in which ejection port arrays of the recording head 101 according to this embodiment are disposed.

As shown in FIG. 2, the recording head 101 of this embodiment separately accommodates the recording chip (Bk chip) 201 for ejecting black ink and the recording chip (Cl chip) 202 for ejecting color ink.

Furthermore, as shown in FIGS. 3A and 3B, the Bk chip 201 includes a Bk ejection port array 203 in which 1,280 ejection ports 211 are arrayed in the Y-direction (a predetermined direction) at a density of 1,200 per inch (corresponding a recording resolution of 1,200 dpi). The Bk chip 201 further includes heaters (recording elements) 212 for generating energy for ejecting ink on the basis of recording data, described later, at positions corresponding the ejection ports 211 arrayed in the Bk ejection port array 203 to form a recording element array. The amount of ink ejected per ejection port for ejecting black ink is 12 ng.

As shown in FIGS. 3A and 3C, the Cl chip 202 includes two C ejection port arrays 204 in which 512 ejection ports 222 for ejecting cyan ink are arrayed in the Y-direction (the predetermined direction) at a density of 1,200 per inch (corresponding to a recording resolution of 1,200 dpi). Similarly, the Cl chip 202 further includes two M ejection port arrays 205 for ejecting magenta ink and two Y ejection port arrays 206 for ejecting yellow ink. The Cl chip 202 further includes heaters (recording elements) 222 for generating energy for ejecting ink on the basis of recording data, described layer, at positions corresponding to ejection ports 221 arrayed individually in the C ejection port arrays 204, the M ejection port arrays 205, and the Y ejection port arrays 206 to form recording element arrays. The amount of ink ejected from each of the ejection ports 221 for ejecting cyan ink, magenta ink, and yellow ink is 6 ng. The two C ejection port arrays 204 are disposed at positions near both ends of the Cl chip 202 in the X-direction. The two Y ejection port arrays 206 are disposed at positions near the center of the Cl chip 202 in the X-direction. In the follow description, the cyan ink, magenta ink, yellow ink are also referred to collectively as color ink, and the six ejection port arrays arrayed in the Cl chip 202 are also referred to collectively as Cl ejection port arrays 204 to 206.

Figure 4:
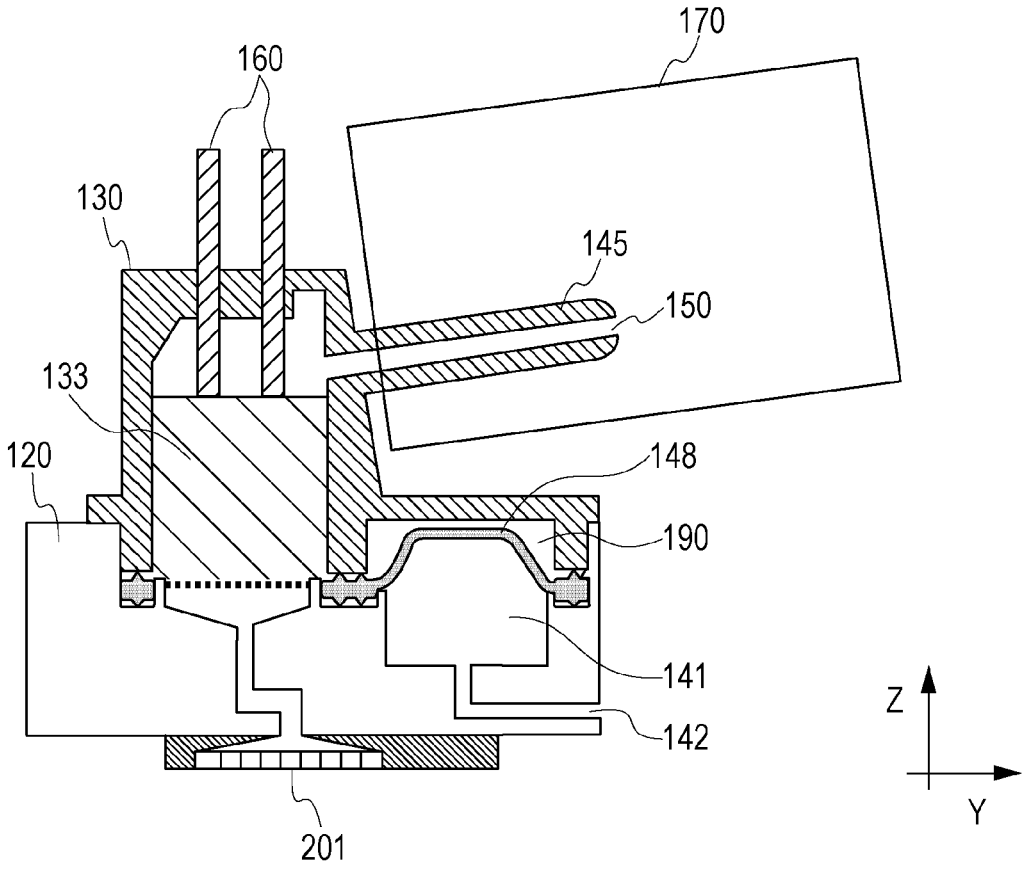
FIG. 4 is a cross-sectional view of the recording head and an ink tank according to an embodiment.

FIG. 4 is a schematic cross-sectional view of the head cartridge 100. FIG. 4 schematically shows a cross-section of the head cartridge 100 taken along the Y-direction at a position at which the Bk chip 201 is disposed as viewed from the X-direction.

A head unit 120 connects to an ink tank 170 via a subtank 130 provided in the recording head 101. The subtank 130 includes a supply tube 145 projecting in a direction perpendicular to the X-direction and an ink supply port 150 at the end thereof and is in engagement with a supply port of the ink tank 170.

The subtank 130 includes a joint chamber 133 in which electrode pins 160 are disposed. The electrode pins 160 connect to an electrical circuit (not shown). If the interface of the ink in the joint chamber 133 is lower than the lower ends of the electrode pins 160, the electrode pins 160 are not conducting, allowing detecting that the amount of remaining ink has become smaller than a predetermined value. In this embodiment, the electrode pins 160 are disposed so that the amount of remaining ink is about 1.2 g when the interface of the ink reaches the lower ends of the electrode pins 160. An electrical signal from the electrode pins 160 is transmitted to the recording apparatus 1000, and a microprocessor unit (MPU) and an application specific integrated circuit (ASIC), described later, change a remaining amount status, which is stored in a random access memory (RAM), described later, in response to reception of the signal.

An elastic member 148 is disposed in an ink chamber 190 communicating with the joint chamber 133. A communication port 142 connects to a suction pump (not shown), so that a buffer chamber 141 can be brought into negative pressure by driving the suction pump. When the buffer chamber 141 is under negative pressure, the elastic member 148 deforms to a concave shape. This allows ink to flow from the ink tank 170 to the joint chamber 133. After the ink flows in, air accumulates in the upper part of the joint chamber 133. When the pressure in the buffer chamber 141 is returned to atmospheric pressure in that state, the elastic member 148 returns to a convex shape to allow the air accumulating in the upper part of the joint chamber 133 to be pushed out to the ink tank 170. In this embodiment, the ink in the ink tank 170 is brought to the joint chamber 133 by repeating the above operation. The ink is supplied from the joint chamber 133 to common liquid chambers 210 and 220 in the respective chips 201 and 202.

Figure 5:
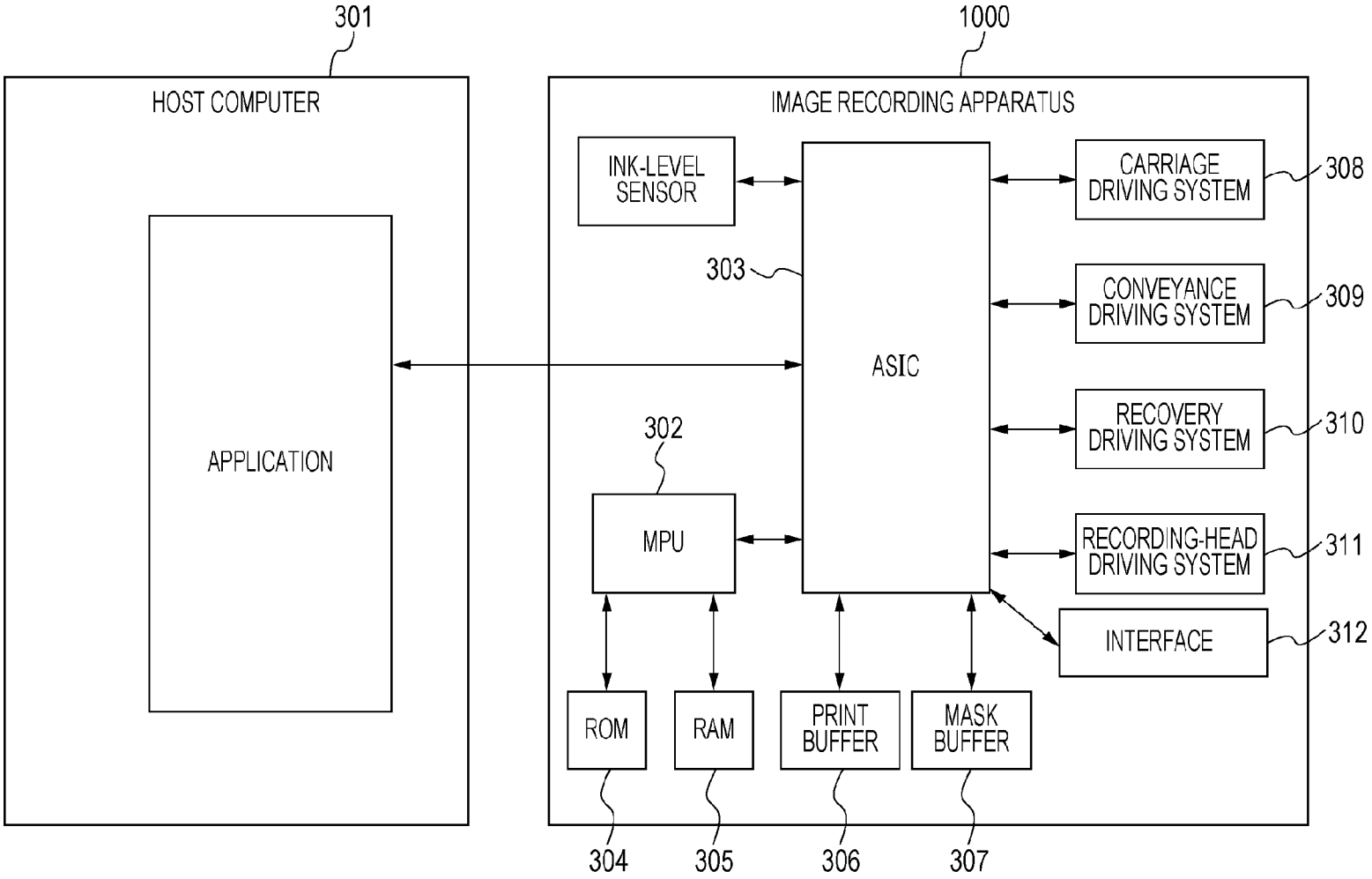
FIG. 5 is a block diagram showing a recording control system according to an embodiment.

FIG. 5 is a block diagram showing the schematic configuration of a recording control system according to this embodiment.

A host computer 301, which is an image input unit, transmits RGB multilevel image data stored in various kinds of storage medium, such as a hard disk and a memory, to an image processing unit in the recording apparatus 1000.

The image processing unit includes a n MPU 302 and an ASIC 303, described later. The multilevel image data can also be received from an external image input device, such as a scanner and a digital camera, connected to the host computer 301. The image processing unit generates binary recording data for use in ejecting ink from the recording head 101 by binarizing and masking the input multilevel image data.

The recording apparatus 1000, which is an image output unit, records an image by applying ink on a recording medium 3 on the basis of the binary image data for ink, generated by the image processing unit. The recording apparatus 1000 is controlled by the MPU 302 according to a program stored in a ROM 304. A RAM 305 functions as a work area or a temporary data storage area for the MPU 302. The MPU 302 controls, via the ASIC 303, a driving system 308 for the carriage 6, a conveyance driving system 309 for the recording medium 3, a recovery driving system 310 for the recording head 101, a driving system 311 for the recording head 101, and an interface 312. The recovery driving system 310 is a system for sucking ink through the ejection ports of the recording head 101, wiping ejection-port formed surfaces, preliminary ejection, and so on.

A print buffer 306 temporarily stores recording data converted to a format in which the data can be transferred to the recording head 101.

The mask buffer 307 temporarily holds a plurality of mask patterns that are applied when the recording data is transferred to the recording head 101. The plurality of mask patterns are used in, among a plurality of recording modes, described later, a recording mode in which ink is ejected along with a plurality of scanning operations of the recording head on a unit area of a recording medium, that is, using a multipass recording method. The plurality of mask patterns are prepared in the ROM 304, from which an appropriate mask pattern is read for actual recording and is stored in the mask buffer 307.

Although this embodiment is described as applied to a configuration in which the image processing unit is disposed in the recording apparatus 1000, the image processing unit may be disposed in the host computer 301.

In this embodiment, one recording mode is selected for execution from a plurality of recording modes in which the number of times the recording head is caused to scan a unit area on a recording medium differs depending on the recording conditions. Recording modes that are executable in this embodiment will be described in detail hereinbelow.

Figures 6, 7:
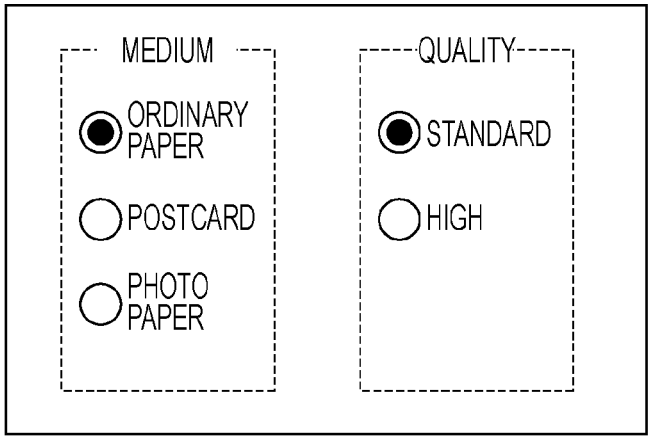
FIG. 6 is a schematic diagram illustrating a window of an interface of the recording apparatus according to an embodiment.
FIG. 7 is a table showing the relationship between recording modes and the number of scans according to an embodiment.

FIG. 6 is a schematic diagram illustrating an example of the window of the interface 312 for a user to select recording conditions, shown on a display of the host computer 301.

First, the ink-jet recording apparatus of this embodiment performs recording depending on the kind of a recording medium that the user selects from ordinary paper, postcard, and photo paper as a recording medium. The user can also select a recording quality of the image to be recorded from "standard" and "high". If "high" is selected for the recording quality, the number of scans of a unit area on the recording medium is set more than that for "standard". Thus, the quality of an image recorded with the recording quality "high" is higher than that for "standard", but the throughput is lower.

In this embodiment, the number of times the recording head is caused to scan the unit area on the recording medium (hereinafter also referred to as pass count) is determined on the basis of a combination of information items about the kind of the recording medium and recording quality.

FIG. 7 is a table showing a way for determining the number of passes depending on the recording conditions in this embodiment.

In this embodiment, the pass count can be set to one pass, two passes, five passes, or seven passes depending on the information about various recording conditions. In the case where a recording medium for use in recording is ordinary paper, recording is performed with one pass for recording quality "standard", and five passes for recording quality "high" in both of double-sided recording and one-sided recording. Postcards tend to cause beading as compared with ordinary paper. Therefore, in the case where the recording medium is a postcard, recording is performed with a relatively large pass count, two passes for recording quality "standard", and five passes for recording quality "high". Since photo paper tends to cause beading more than postcards, a larger pass count is set. Specifically, in the case where the recording medium is photo paper, recording is performed with five passes for recording quality "standard", and seven passes for recording quality "high".

Figure 8A:
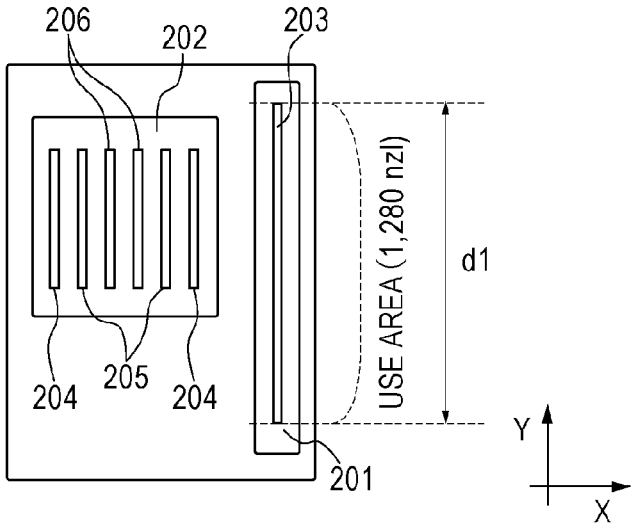
FIG. 8A is a diagram illustrating a recording mode executable in an embodiment.
Figure 8B:
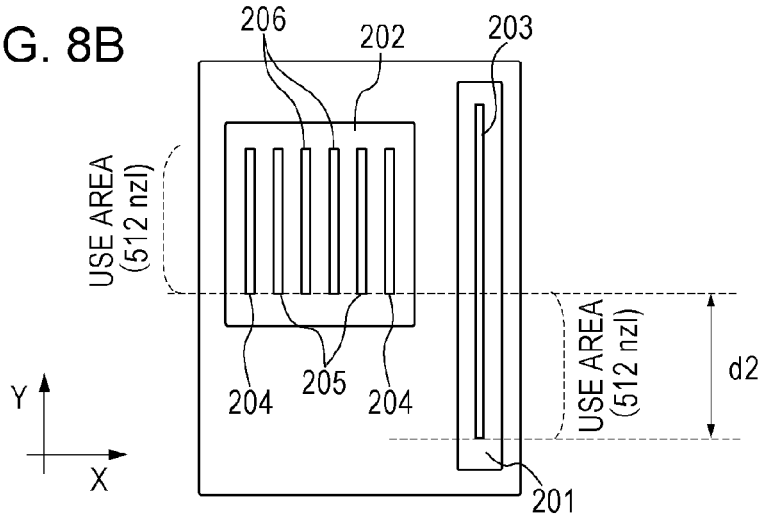
FIG. 8B is a diagram illustrating a recording mode executable in an embodiment.
Figure 8C:
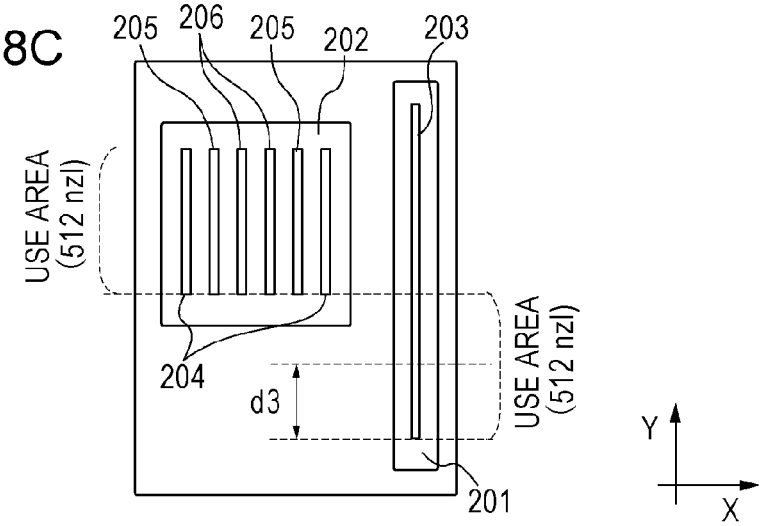
FIG. 8C is a diagram illustrating a recording mode executable in an embodiment.

FIGS. 8A to 8C are diagrams illustrating a recording method in recording modes executable in this embodiment.

FIG. 8A schematically shows a method of recording in the case where monochrome recording data is input in a one-pass recording mode. In this case, the unit area on a recording medium is an area having a distance d1 corresponding to the length of 1,280 ejection ports of the Bk ejection port array 203 in the Y-direction. All of the 1,280 ejection ports of the Bk ejection port array 203 are available during one scan with the recording head, through which ink is emitted on the basis of recording data. None of the Cl ejection port arrays 204 to 206 are used. After completion of the scan, the recording medium is conveyed in the Y-direction by the distance d1. Thereafter, ejection of black ink through the 1,280 available ejection ports based on the recording data along with scanning with the recording head 101 and conveyance of the recording medium in the Y-direction by the distance d1 are alternately repeated to perform recording on all the unit areas on the recording medium.

FIG. 8B schematically shows a recording method in the case where color recording data is input in the one-pass recording mode. In this case, among the 1,280 ejection ports of the Bk ejection port array 203, 512 ejection ports arrayed at an upstream end in the Y-direction are used for recording. The recording uses all of the ejection ports of the C ejection port arrays 204, the M ejection port arrays 205, and the Y ejection port arrays 206.

Figure 9:
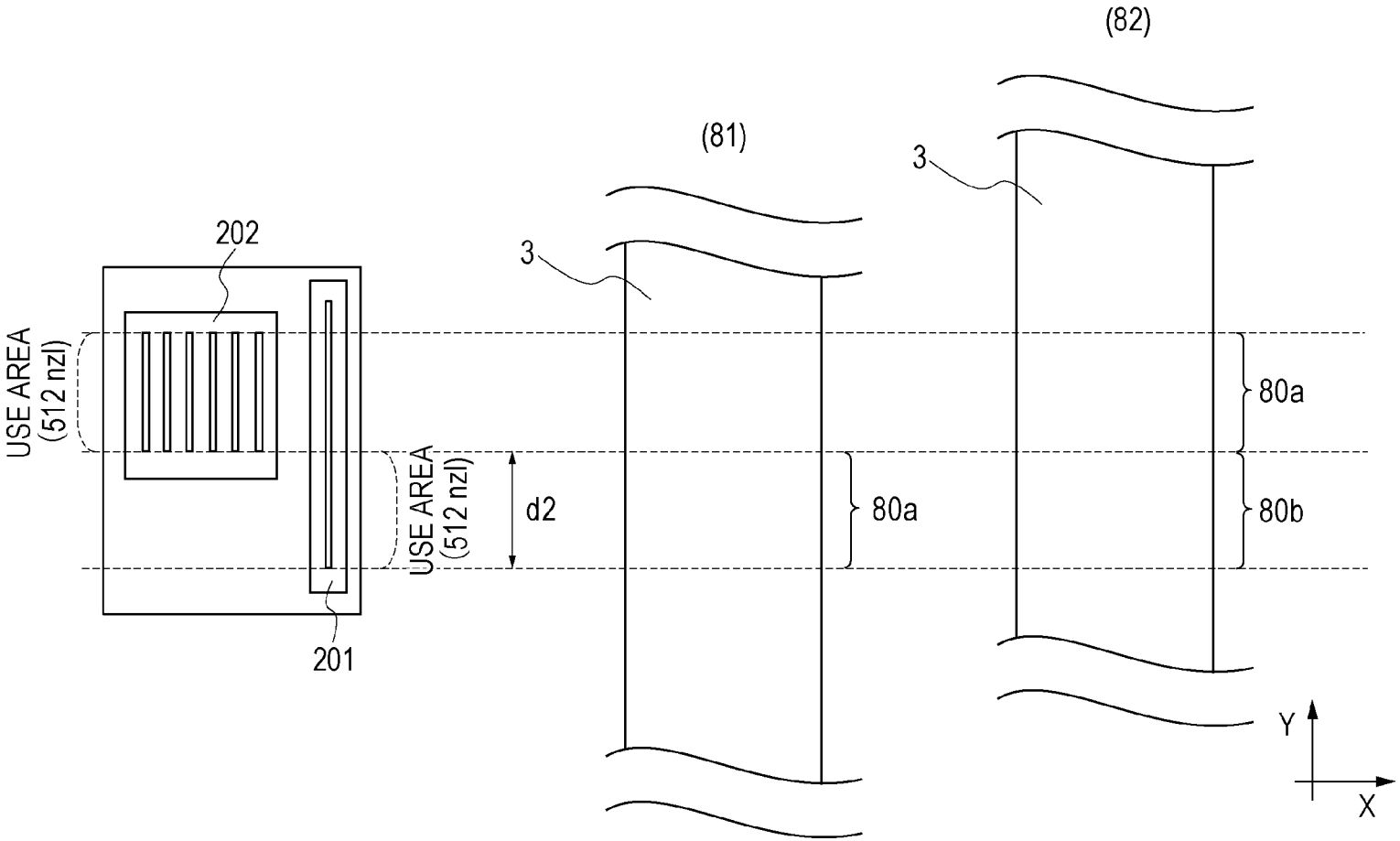
FIG. 9 is a diagram illustrating a one-pass recording mode according to an embodiment.

FIG. 9 is a diagram illustrating the process of recording according to the method of recording in the case where color recording data is input in the one-pass recording mode.

The unit area on the recording medium in this case is an area having a distance d2 corresponding to the length of the 512 ejection ports in the Y-direction at the upstream end of the Bk ejection port array 203 in the Y-direction.

In an actual method of recording, when a unit area 80*a* on the recording medium 3 is at a position (81) at which the unit area 80*a* faces the 512 ejection ports in a use area of the Bk ejection port array 203, black ink is ejected from the 512 ejection ports in the use area of the Bk ejection port array 203 to the unit area 80*a* while the recording head 101 is moved for one scan. Next, the recording medium 3 is conveyed downstream in the Y-direction by the distance d2. This allows the recording medium to be conveyed so that the unit area 80*a* is moved to a position (82) at which the unit area 80*a* faces the C ejection port arrays 204, the M ejection port arrays 205, and the Y ejection port arrays 206. After the conveyance, the recording head 101 is moved in a direction opposite to the preceding direction, and color ink is ejected to the unit area 80*a*. In scanning at the position (82), black ink is ejected to a unit area 80*b* adjacent to the unit area 80*a* downstream in the Y-direction. From then on, ejection of the black ink to the unit area along with scanning with the recording head 101, ejection of the color ink to a unit area adjacent to the unit area downstream in the Y-direction, and conveyance of the recording medium in the Y-direction by the distance d2 are alternately repeated to perform recording on the entire area of the recording medium.

For each unit area in the recording shown in FIG. 9, recording with black ink is first performed, and recording with color ink is performed with the next scan. This causes time difference corresponding to one scan between application of the black ink and application of the color ink, preventing smearing between the black ink and the color ink.

FIG. 8C is a schematic diagram showing a method of recording in the case where color recording data is input in a two-pass recording mode.

In this case, like the case shown in FIG. 8B, the 512 ejection ports of the Bk ejection port array 203 upstream in the Y-direction and all of the ejection ports of the Cl ejection port arrays (the C ejection port arrays 204, the M ejection port arrays 205, and the Y ejection port arrays 206) are available. The unit area in this case is an area having a distance d3 corresponding to the length of 256 ejection ports upstream in the Y-direction among the 512 ejection ports in the use area of the Bk ejection port array 203 in the Y-direction. In this case, recording is performed for one unit area on the basis of recording data in the order of ejection of black ink through the 256 ejection ports upstream in the Y-direction among the 512 ejection ports in the use area of the Bk ejection port array 203 along with scanning, ejection of black ink through 256 ejection ports downstream in the Y-direction among the 512 ejection ports in the use area of the Bk ejection port array 203 along with scanning, ejection of color ink through 256 ejection ports upstream in the Y-direction among the 512 ejection ports in the use area of the Cl ejection port arrays 204 to 206 along with scanning, and ejection of color ink through 256 ejection ports downstream in the Y-direction among the 512 ejection ports in the use areas of the Cl ejection port arrays 204 to 206 along with scanning. Between the individual scans, the recording medium is conveyed by the distance d3 downstream in the Y-direction.

Recording data for use in ejecting black ink through the 256 ejection ports of the Bk ejection port array 203 upstream in the Y-direction is generated using a mask pattern A. Recording data for use in ejecting black ink through the 256 ejection ports downstream in the Y-direction of the Bk ejection port array 203 is generated using a mask pattern B. The mask patterns A and B include recordable pixels at positions exclusive and complementary to each other.

The above method allows recording on a unit area on the recording medium by ejecting ink of the same color along with two scans.

Although FIG. 8C shows the two-pass recording mode, the five-pass recording mode and the seven-pass recording mode allow recording with substantially the same operation except the number of scans performed to complete recording.

In the one-pass recording mode of this embodiment shown in FIGS. 8A and 8B, if the total number of times the recording elements are driven per scan is large, so that large power may be consumed, a method of recording in which power consumption for one scan is reduced is executed.

Specifically, a cumulative total of the dots of black ink recorded in a unit area during scanning is counted before the unit area is scanned with the recording head 101 (dot count). When the cumulative total of the dots is equal to or larger than a predetermined threshold value, a method of recording in which power consumption is reduced is executed. If the cumulative total of the dots is less than the predetermined threshold value, the methods of recording shown in FIGS. 8A and 8B are executed.

FIGS. 10A1 to 10B2 are diagrams illustrating methods of recording in which power consumption is reduced in this embodiment. FIGS. 10A1 and 10A2 schematically show a method of recording in which power consumption is reduced in the case where monochrome recording data is input. FIGS. 10B1 and 10B2 schematically show a method of recording in which power consumption is reduced in the case where color recording data is input.

In this embodiment, in the case where power consumption may be large, an increase in power consumption is prevented by performing divided recording.

For example, when monochrome recording data is input in the one-pass recording mode, ink is ejected through all of the 1,280 ejection ports of the Bk ejection port array 203 during one scan, as shown in FIG. 8A. However, if the number of the dots is large, so that the power consumption may be large, recording is performed with two scans even in the one-pass recording mode. Specifically, as shown in FIG. 10A1, among the 1,280 ejection ports of the Bk ejection port array 203, only 640 ejection ports upstream in the Y-direction are used to eject ink. Next, as shown in FIG. 10A2, only 640 ejection ports downstream in the Y-direction of the Bk ejection port array 203 are used to eject ink without conveying the recording medium. After completion of the recording, the recording medium is conveyed by the distance d1 in the Y-direction, as shown in FIG. 8A, and the recording on the unit area is completed.

By ejecting ink using a limited number of ejection ports with divided two (L) scans, as shown in FIGS. 10A1 and 10A2, without conveying the recording medium, recording as in the case where ink is ejected on the basis of the recording method shown in FIG. 8A can be performed. Furthermore, the total number of time the recording elements are driven per scan is almost halved, thus allowing recording in which an increase in power consumption is prevented.

Also for a case in which color recording data is input, if the number of the dots is large, causing high power consumption, black ink and color ink are ejected with two divided scans for recording even in the one-pass recording mode. Among the 512 ejection ports in the use area of the Bk ejection port array 203 in FIG. 8B, only the 256 ejection ports upstream in the Y-direction are made available as shown in FIG. 10B1. Among the 512 ejection ports in the use area of the Cl ejection port arrays 204 to 206 in FIG. 8B, only 256 ejection ports upstream in the Y-direction are made available. In the state shown in FIG. 10B1, black ink and color ink are ejected. Next, ink is ejected using 256 ejection ports downstream in the Y-direction of the Bk ejection port array 203 and 256 ejection ports of each of the Cl ejection port arrays 204 to 206, as shown in FIG. 10B2, without conveying the recording medium.

Thus, also in the case in which color recording data is input, recording as in the case where ink is ejected on the basis of the recording method shown in FIG. 8B can be performed by ejecting ink through a limited number of ejection ports with divided two scans, as shown in FIGS. 10B1 and 10B2. This allows recording in which an increase in power consumption is prevented.

In this embodiment, various recording controls are executed as the amount of ink remaining in the recording head 101 decreases.

A method for controlling printing depending on the amount of remaining ink will now be described in detail.

Figure 11:
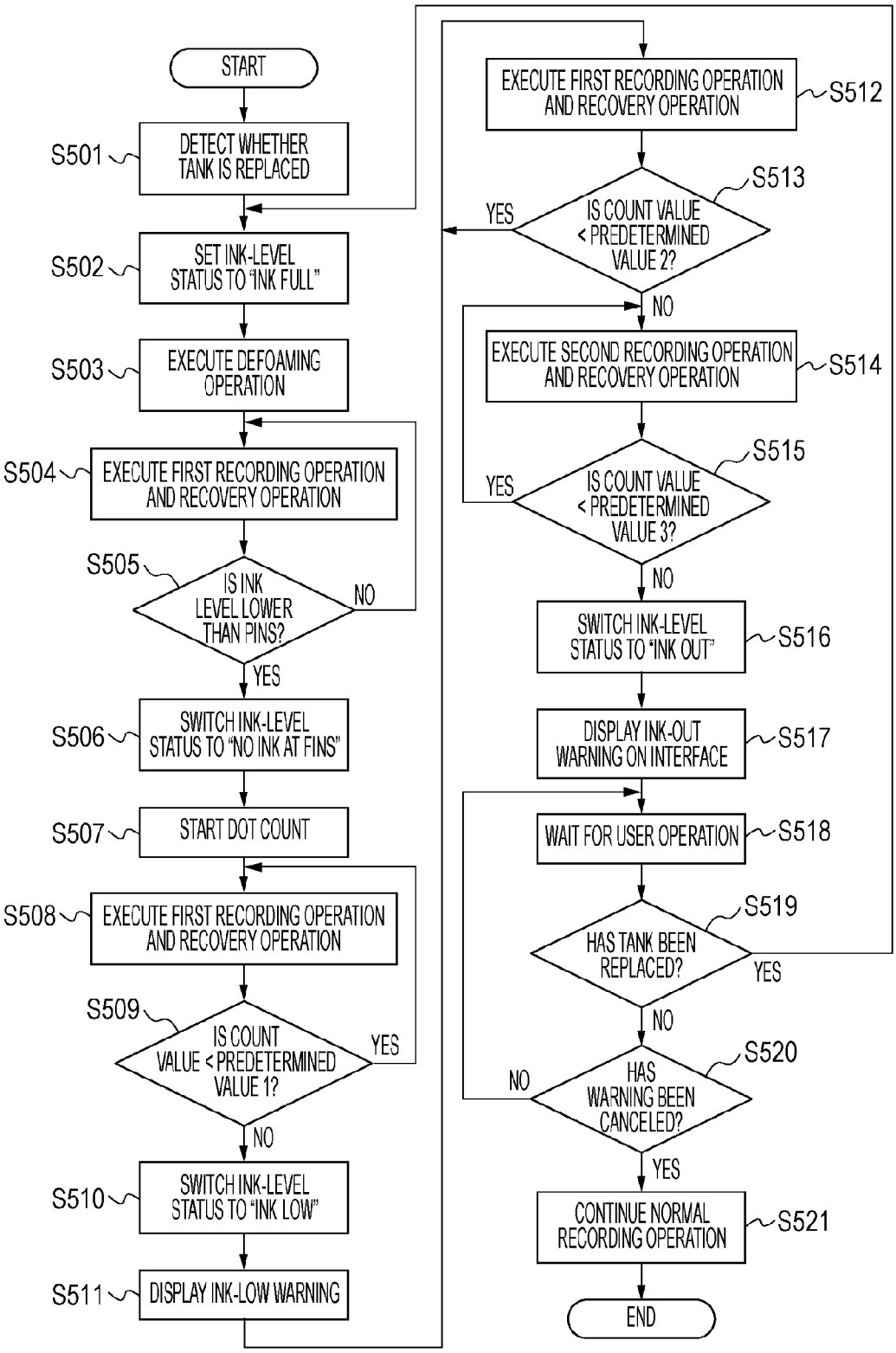
FIG. 11 is a flowchart showing a recording operation according to an embodiment.

FIG. 11 is a flowchart showing a control method depending on the amount of remaining ink in this embodiment. A program for the flowchart shown in FIG. 11 is stored in the ROM 304. The program is written to the RAM 305 and is executed by the MPU 302.

When it is detected that the ink tank 170 is replaced by the user (S501), it is determined that a sufficient amount of ink remains, and the ink-level status of the recording apparatus 1000 is set to "INK FULL" (S502). An ink charging operation for filling the joint chamber 133 with ink by driving the suction pump connected to the communication port 142, shown in FIG. 4, and a defoaming operation is executed (S503).

Subsequently, when a recording job is input, a first recording operation and a recovery operation are executed (S504). The first recording operation is a normal recording operation that is executed when a large amount of ink remains, and a corresponding chip may not excessively increase in temperature, in which recording is performed depending on the set recording mode, as shown in FIGS. 8A to 8C, FIG. 9, and FIGS. 10A1 to 10B2.

When it is detected that ink is consumed in the first recording operation and the recovery operation and that the interface of the ink in the joint chamber 133 becomes lower than the lower ends of the electrode pins 160 (S505), the ink-level status is switched to "NO INK AT PINS" (S506), and counting of ink consumption (a cumulative total of the ink ejection amount) is started (S507). The electrode pins 160 are disposed so that the interface of the ink reaches the lower ends of the electrode pins 160 when the amount of remaining ink reaches about 1.2 g. Thus, the amount of remaining ink at the time that the counting of the ink consumption is started at S507 is about 1.2 g (a predetermined amount).

The counting of ink consumption at S507 is the operation of counting the amount of ink consumed in the recording operation. Specifically, the ink consumption is calculated by counting the number of dots ejected from the recording head 101 and multiplying the counted value by an ejection amount per ejection port. The actual ejection amount may have an error of ±10% from a standard ejection amount. Therefore, this embodiment uses a standard ejection amount plus +10% as an ejection amount per ejection port.

Although this embodiment is descried as applied to the case that the amount of ink consumed in the recording operation is counted, the amount of ink consumed in the recovery operation may be further counted. In this case, a predetermined amount of ink to be consumed in suction recovery is added to the counted value every time suction recovery is executed. A value corresponding to an ink consumption per recovery operation may be determined depending on the variation in suction amount. For example, if the variation in suction amount is ±20%, the maximum suction amount +20% may be determined as a value corresponding to an ink consumption per recovery operation.

After the counting of ink consumption is started at S507, the first recording operation and recovery operation are continuously executed (S508). When the counting of ink consumption advances, and it is determined that the counted value has reached a predetermined value 1 (in this embodiment, 0.1 g) (S509), the ink-level status is switched to "INK LOW" (S510), and an "INK LOW" warning indicating that the ink level becomes low is displayed on the interface 312 of the recording apparatus 1000 (S511). The "INK LOW" warning is a warning for notifying the user that the ink level becomes low and the ink will run out soon. No particular operation, such as stopping the recording operation, is performed.

Thereafter, the first recording operation and recovery operation are continued (S512). If it is determined that the counted ink consumption has reached a predetermined value 2 (a predetermined cumulative total, in this embodiment, 0.5 g) (S513), the recording operation is switched from the first recording operation to a second recording operation, described later, and the second recording operation and recovery operation are executed (S514).

In this embodiment, the predetermined value 2 is set to 0.5 g, as described above. The reason will be described in detail hereinbelow.

In the recording apparatus 1000 of this embodiment, the maximum recording duty (the possible maximum duty of the image processing unit) in the one-pass recording mode and the two-pass recording mode is set to 84%. Since the recording apparatus 1000 of this embodiment is equipped for recording media within A4-size (8.27 inch×11.69 inch), the maximum amount of Bk ink consumed in recording one page is calculated as follows: 8.27 (inch)×600 (ppi)×11.69 (inch)×600 (ppi)×2 (dot)×84(%)×12 (ng)=0.7 (g). Since an available amount of ink is 0.7 g, ink will not run out during recording on one page regardless of recording data that the ejection is based on if the counted ink consumption is equal to or smaller than 0.5. In other words, setting the predetermined value 2 at 0.5 g prevents an excessive rise in temperature due to running-out of ink during the first recording operation in the recording on the page. Therefore, in this embodiment, the predetermined value 2 is set to 0.5 g, and when the counted ink consumption becomes the predetermined value 2 or less, a second recording operation for preventing an excessive rise in temperature, described later, is executed.

When the counting of ink consumption further advances, and it is determined that the consumption has reached a predetermined value 3 (in this embodiment, 0.9 g) (S515), the ink-level status is switched to "INK OUT" (S516), and an "INK OUT" warning indicating that the ink has run out on the interface 312 (S517) after the recording on the page is finished and stops the recording operation of the recording apparatus 1000 (S518). Since the amount of remaining ink when the dot count is started at S507 is about 1.2 g, the amount of remaining ink when the ink counting of ink consumption has reached the predetermined value 3 is about 0.3 (=1.2−0.9) g. Therefore, if recording of an image that needs a large amount of ink is executed, the ink can run out during the recording.

When the "INK OUT" warning is displayed, and it is determined that the ink tank 170 is replaced by the user (S519) while the recording operation of the recording apparatus 1000 is stopped, the process is returned to S502, and the ink-level status is reset to "INK FULL", and a recording operation is executed.

If the user wants to continue the recording although the ink can run out, the "INK OUT" warning is cancelled by user input (S520) to continue the recording operation (S521).

The second recording operation of this embodiment will be described in detail hereinbelow. A case in which monochrome recording data is input will be described for illustrative purpose.

Figure 12A:
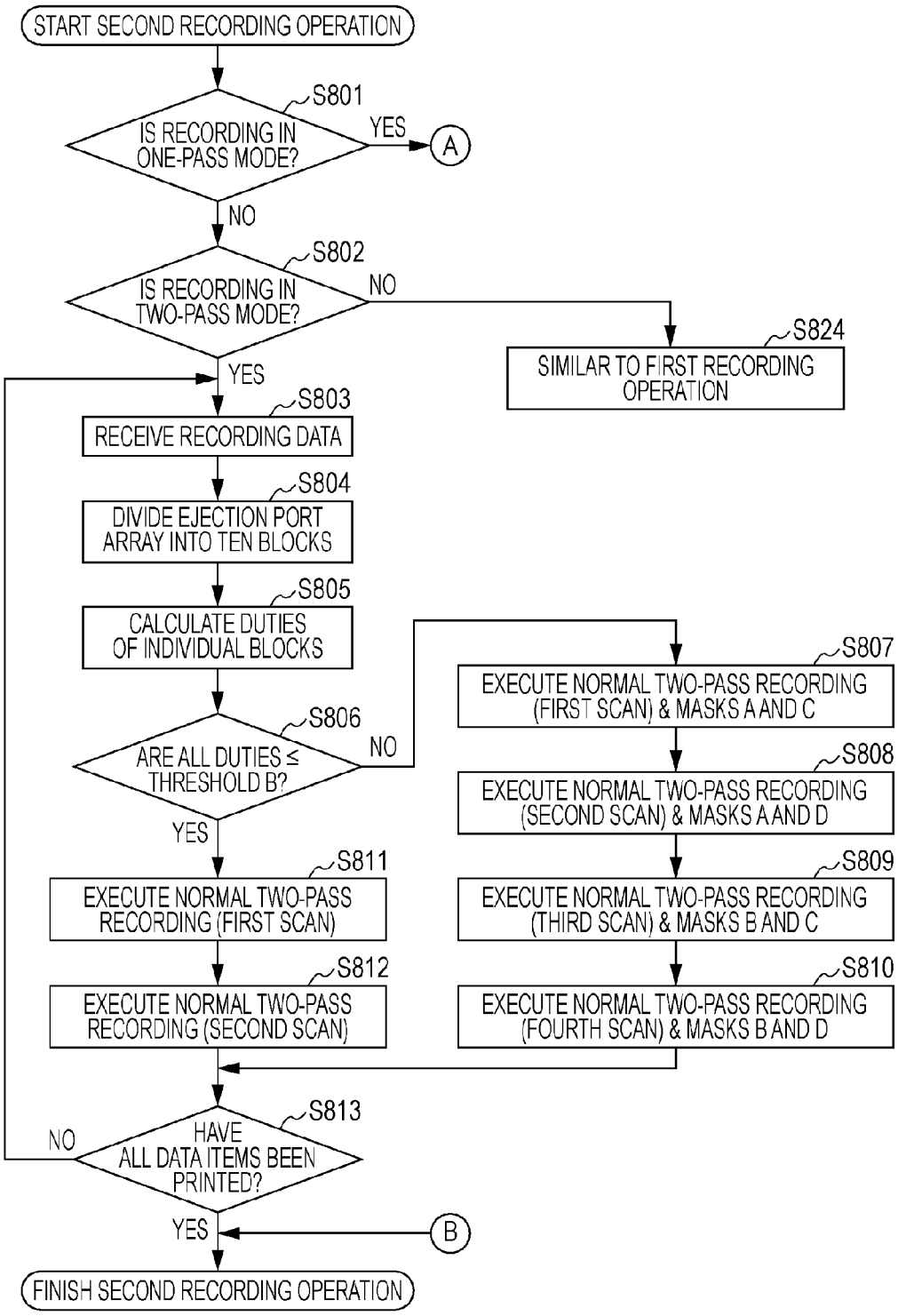
FIG. 12A is a flowchart showing a second recording operation according to an embodiment.
Figure 12B:
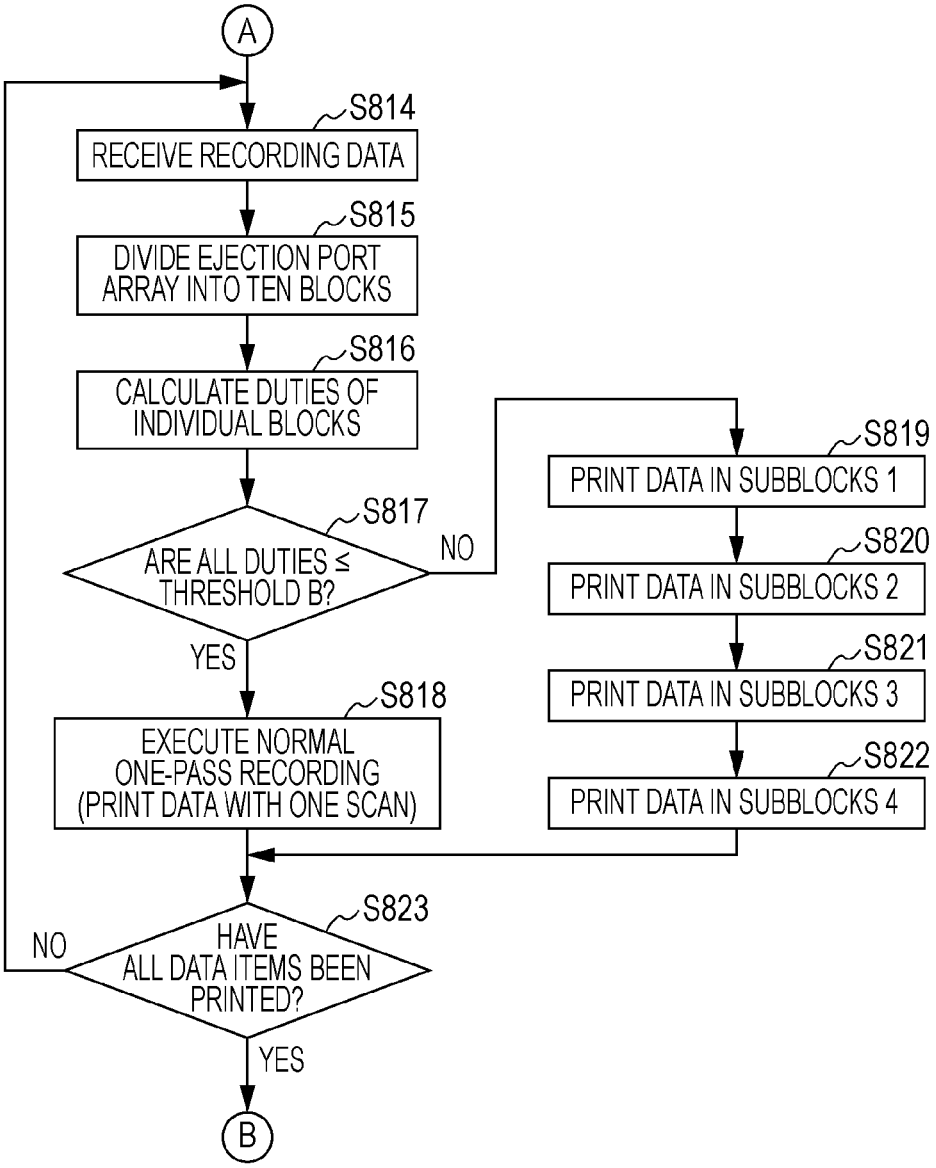
FIG. 12B is a flowchart showing the second recording operation according to an embodiment.

FIGS. 12A and 12B are flowcharts showing the second recording operation at S514 in FIG. 11. A program for the flowchart shown in FIGS. 12A and 12B is stored in the ROM 304, is written to the RAM 305, and is executed by the MPU 302.

First, a determination on the recording mode is executed at S801 and S802. If it is the one-pass recording mode, the process from S814 to S823 is executed. If it is the two-pass recording mode, the process from S803 to S813 is executed. In the five-pass recording mode and the seven-pass recording mode, the number of scans executed for a unit area is large, so that the total number of times the recording elements are driven per scan is small, preventing an excessive rise in the temperature of the ejection ports. Accordingly, for the five-pass recording mode and the seven-pass recording mode, this embodiment executes recording similar to that in the first recording operation (S824).

If it is determined at S801 that the recording mode is the one-pass recording mode, recording data transmitted from the host computer 301 is received (S814), and the 1,280 ejection ports in the Bk ejection port array 203 are logically divided into ten blocks (recording element group) (S815).

Figure 13:
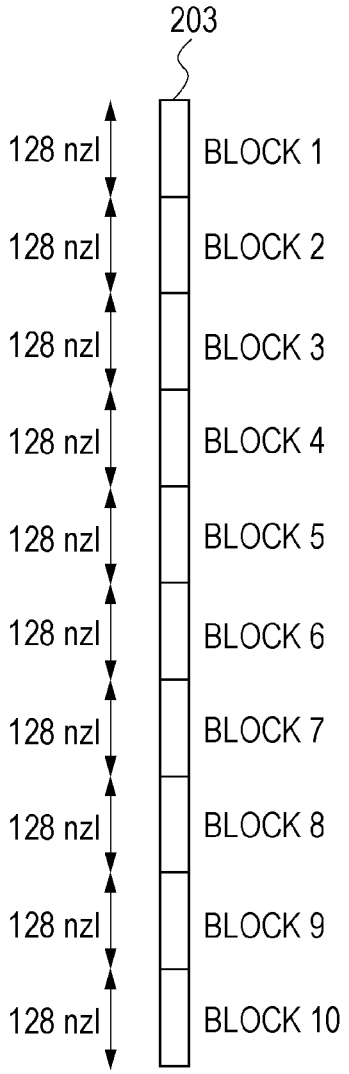
FIG. 13 is a diagram illustrating the second recording operation according to an embodiment.

FIG. 13 is a diagram illustrating division of the Bk ejection port array 203 at S815.

In this embodiment, the Bk ejection port array 203 is divided into ten blocks each including 128 ejection ports, as shown in FIG. 13.

Next, the number of dots recorded during scanning is counted for each block, and a recording duty, which is a value on the amount of ink ejected during the scanning (S816). Here, the recording duty corresponds to an ink ejection amount per unit area. In this embodiment, a recording duty in the case that two dots are recorded in a lattice cell of 600 dpi×600 dpi (four dots can be recorded with the recording head shown in FIG. 3A) is defined as 100%. Specifically, a recording duty Nb in each block is calculated using Eq. 1:

$$Nb = \text{the number of dots in each block} \div (\text{the width of the recording medium} \times \text{the number of ejection ports}) \div 2 \quad \text{Eq. 1}$$

The width of the recording medium in Eq. 1 is the width of the recording medium in the X-direction in terms of units of 600 dpi. Since the number of ejection ports in each block is 128, the number of ejection ports in Eq. 1 is 128.

Next, if it is determined that the recording duties Nb of all the blocks are equal to or smaller than a threshold value B (a first ejection amount) (S817), an excessive rise in the temperature of the Bk chip 201 is not prone to occur, and recording is performed in one (M) scan of the recording head as in the normal operation (the first recording operation) (S818) (a first recording mode). In this embodiment, a value corresponding to a recording duty of 22% is set as the threshold value B.

If it is determined that at least one of the blocks 1 to 10 has a recording duty Nb higher than the threshold value B, the recording data is divided, and recording is executed with four (N) times of scanning (S819 to S822, a second recording mode).

FIGS. 14A to 14D are diagrams for explaining a method of recording executed at S819 to S822. FIGS. 14A to 14D respectively correspond to recording processes performed at S819 to S822.

In this embodiment, the blocks are each divided into four subblocks (recording element units) 1 to 4, as shown in FIGS. 14A to 14D. Since each block includes 128 continuous ejection ports, each subblock includes 32 ejection ports. The ejection ports of the different subblocks are driven in different scanning operations.

Figure 14A:
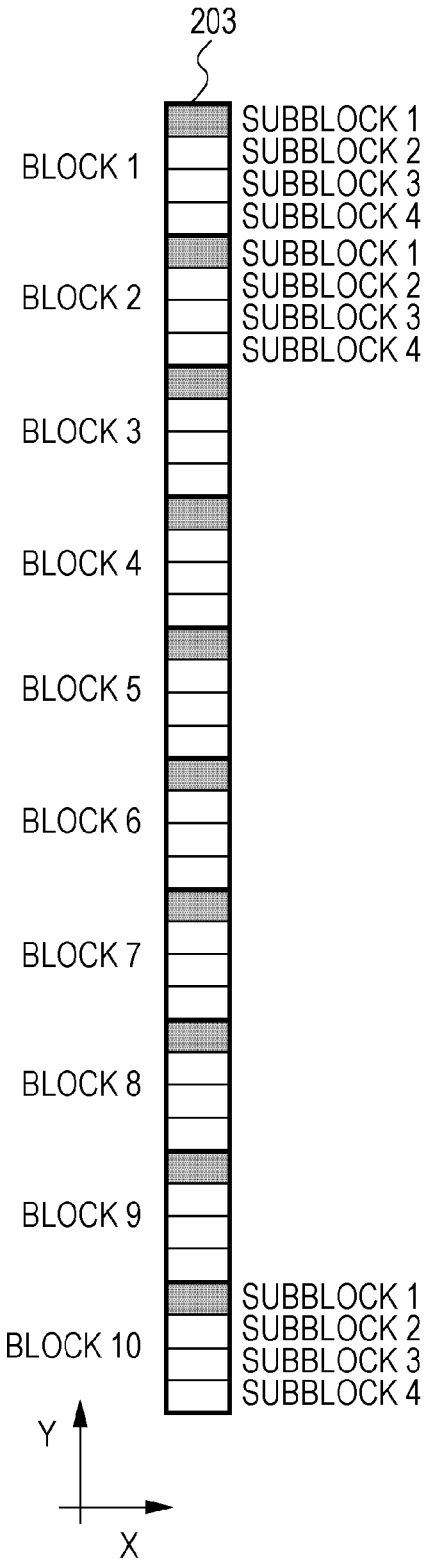
FIG. 14A is a diagram illustrating the second recording operation according to an embodiment.
Figure 14B:
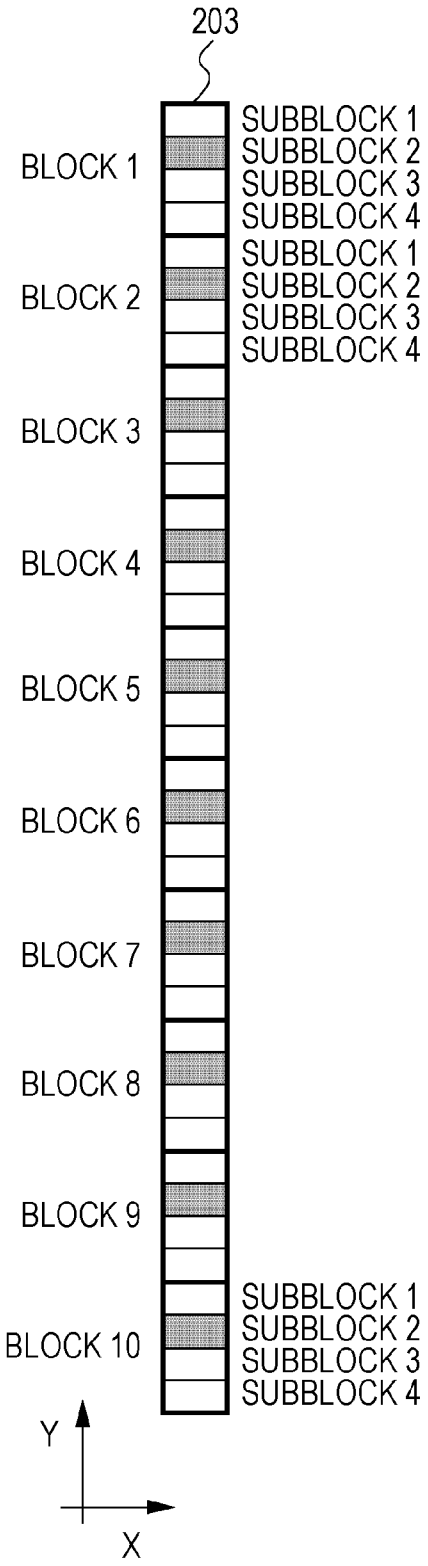
FIG. 14B is a diagram illustrating the second recording operation according to an embodiment.
Figure 14C:
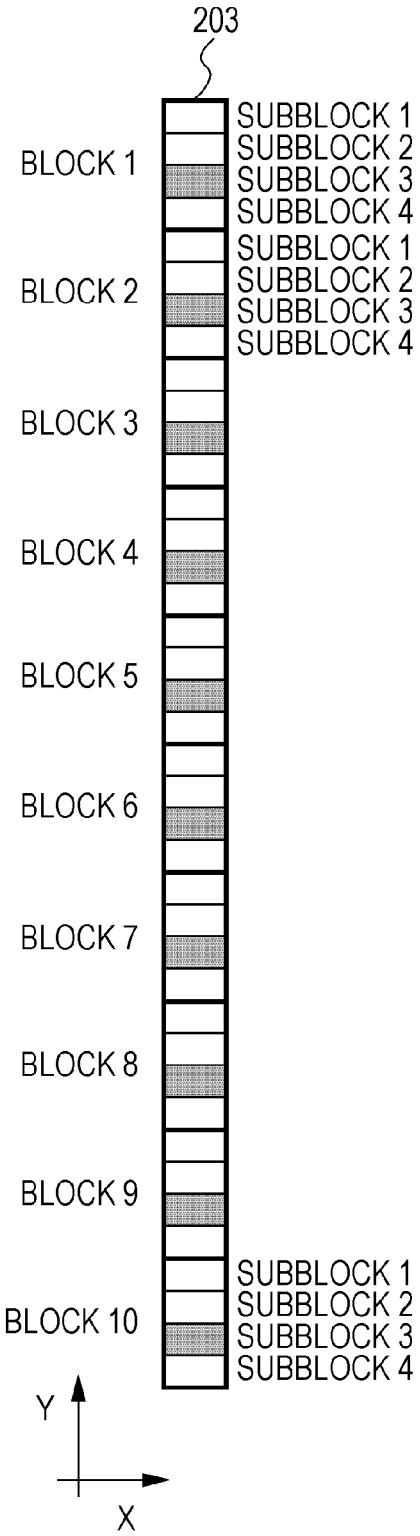
FIG. 14C is a diagram illustrating the second recording operation according to an embodiment.
Figure 14D:
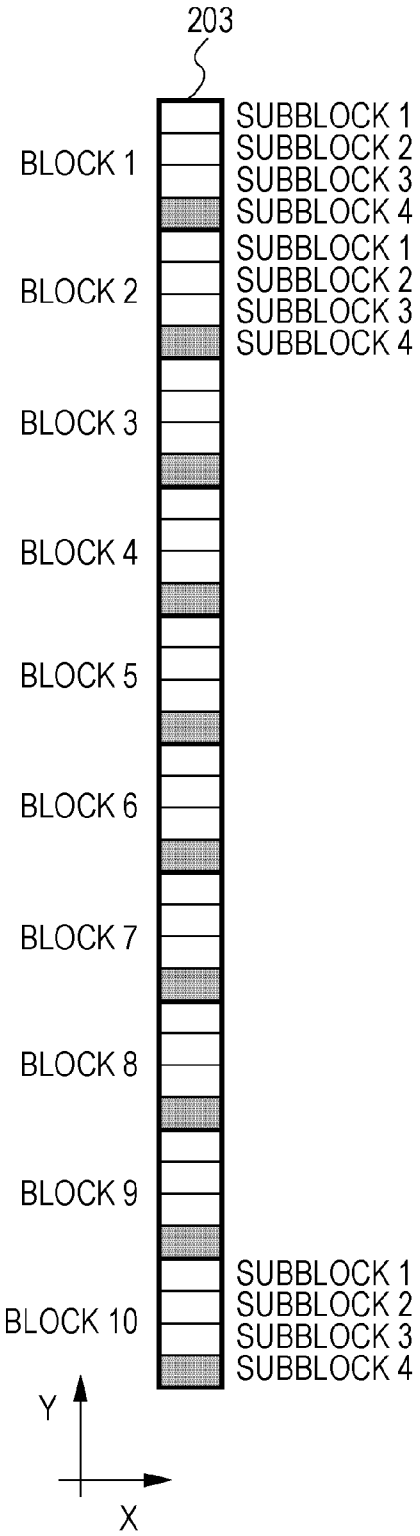
FIG. 14D is a diagram illustrating the second recording operation according to an embodiment.

First, recording elements in the individual subblocks 1 of the blocks 1 to 10 are driven during one scan, as shown in FIG. 14A (S819). After the scan is finished, the recording elements of subblocks 2 of the blocks 1 to 10 are driven during the second scan, as shown in FIG. 14B (S820). Likewise, the recording elements of subblocks 3 and 4 are driven during the third and fourth scans, as shown in FIGS. 14C and 14D (S821 and S822).

Thus, in the second recording operation in the one-pass recording mode of this embodiment, if the recording duty is high, the ejection port array is divided into a plurality of blocks even in the one-pass recording mode, and recording is performed by carrying out a plurality of scans to reduce the power consumption. As described with reference to FIGS. 10A1 to 10B2, if the total number of times the recording elements are driven per scan is large in the first recording operation, recording is performed with two scans. However, if the counted ink consumption has reached the predetermined value 2, an excessive rise in the temperature of the ejection ports cannot be sufficiently prevented only by reducing the total number of times the recording elements are driven per scan to half by dividing the operation into two scans. Therefore, in this embodiment, when the counted ink consumption has reached the predetermined value 2, and the second recording operation is to be executed, the number of divisions for high recording duty is set to four larger than two to further reduce the total number of driving operations. This allows the excessive rise in the temperature of the Bk chip 203 to be well prevented even if ink runs out.

If at S802 the recording mode is determined to be the two-pass recording mode, recording data transmitted from the host computer is received (S803), and the Bk ejection port array 203 is divided into ten blocks (S804). The processes at S803 and S804 are the same as those at S814 and S815, described above.

Next, the recording duties of the individual blocks are calculated (S805). Since the recording duty on the unit area is divided into two scans using the mask patterns A and B, the value found using Eq. 1 divided by 2 is used as the recording duty.

Next, it is determined whether the recording duties of all the blocks are equal to or smaller than the threshold value B (in this embodiment, 22%) (S806). When the recording duties of all the blocks are equal to or smaller than the threshold value B, printing on the unit area is performed by normally carrying out two scans (S811 and S812). If the recording duty of at least one block is larger than the threshold value B, recording is performed with four scans (S807 to S810).

Figure 15A:
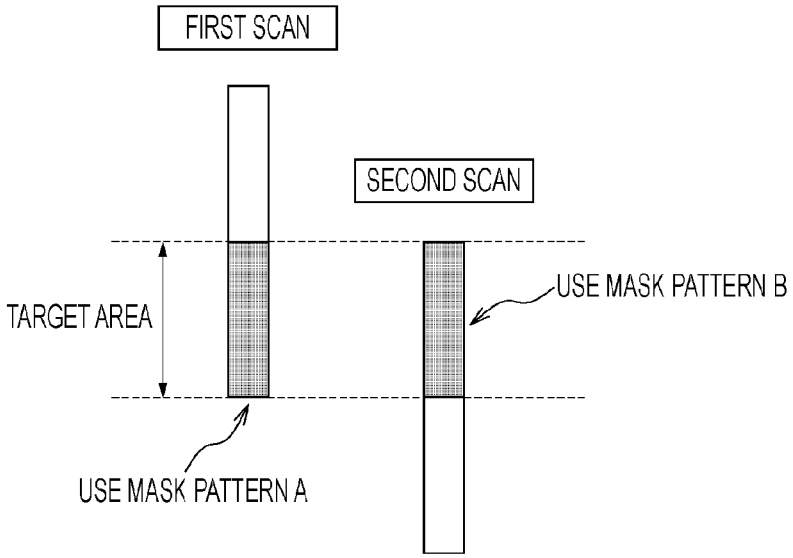
FIG. 15A is a diagram illustrating the second recording operation according to an embodiment.
Figure 15B:
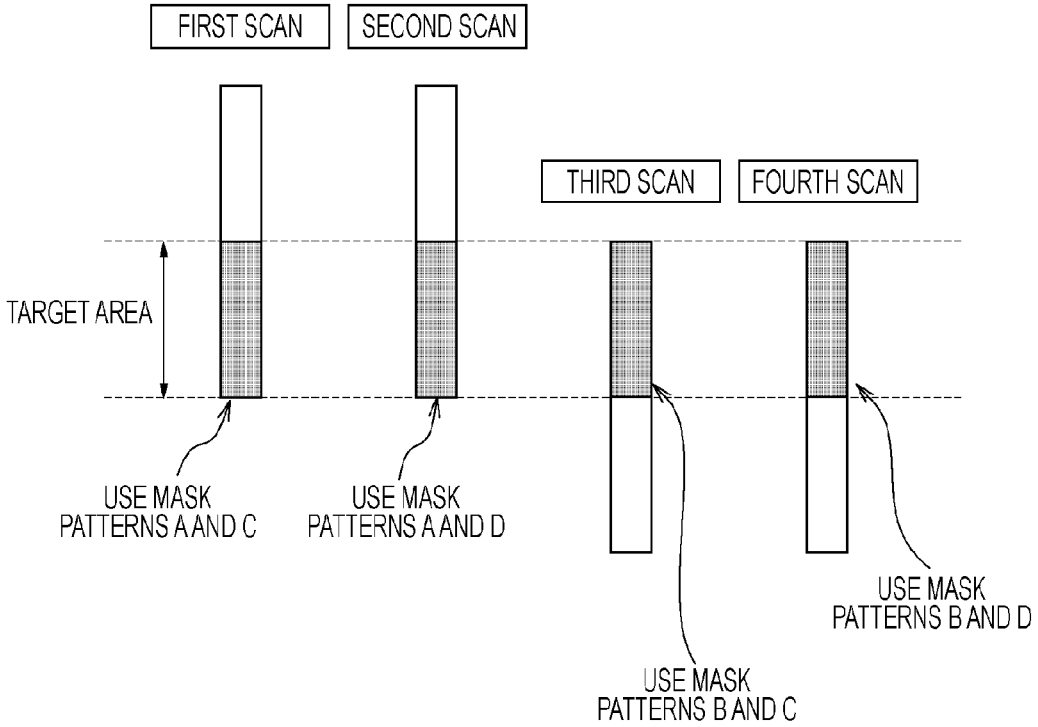
FIG. 15B is a diagram illustrating the second recording operation according to an embodiment.

A specific recording operation is shown in FIGS. 15A and 15B. FIG. 15A is a diagram illustrating the recording operation at S811 and S812. As illustrated, recording on a target area is completed with two scans. During the two scans, ink is ejected on the basis of recording data generated using the mask patterns A and B preset for thinning out the recording data for the two respective scans.

FIG. 15B shows the recording operation from S807 to S810. As illustrated in FIG. 15B, in the first scan, a mask pattern C is used in addition to the mask pattern A to generate recording data. In the second scan, the mask pattern D is used in addition to the mask pattern A to generate recording data. In the third scan, a mask pattern C is used in addition to the mask pattern B to generate recording data. In the fourth scan, the mask pattern D is used in addition to the mask pattern B to generate recording data. The mask patterns C and D have recordable pixels at positions exclusive and complementary to each other.

Thus, this embodiment allows divided recording also for the second recording operation in the two-pass recording mode.

Thus, if the amount of remaining ink is small, and the amount of ink ejected to one unit area is large, this embodiment performs recording with an increased number of scans to the unit area. This allows recording in which an excessive rise in the temperature of the ejection ports is prevented.

If the amount of remaining ink is small, and the amount of ink ejected to one unit area is small, recording is continued with a small number of scans on the unit area. Thus, for the case that an excessive rise in the temperature of the ejection ports is not prone to occur, this allows recording in which a decrease in throughput is prevented.

In the first embodiment, it is determined whether the temperature of the ejection ports can excessively rise irrespective of an image to be recorded on the entire width of the recording medium in the X-direction.

In a second embodiment, the tendency of an excessive rise in the temperature of the ejection ports is determined from the size of an image to be recorded.

The same as that of the first embodiment will be omitted.

In this embodiment, the dimension of an image recorded in a unit area in the X-direction is calculated on the basis of the recording data, and the scanning area of the recording head 101 is changed depending on the size.

Figure 16:
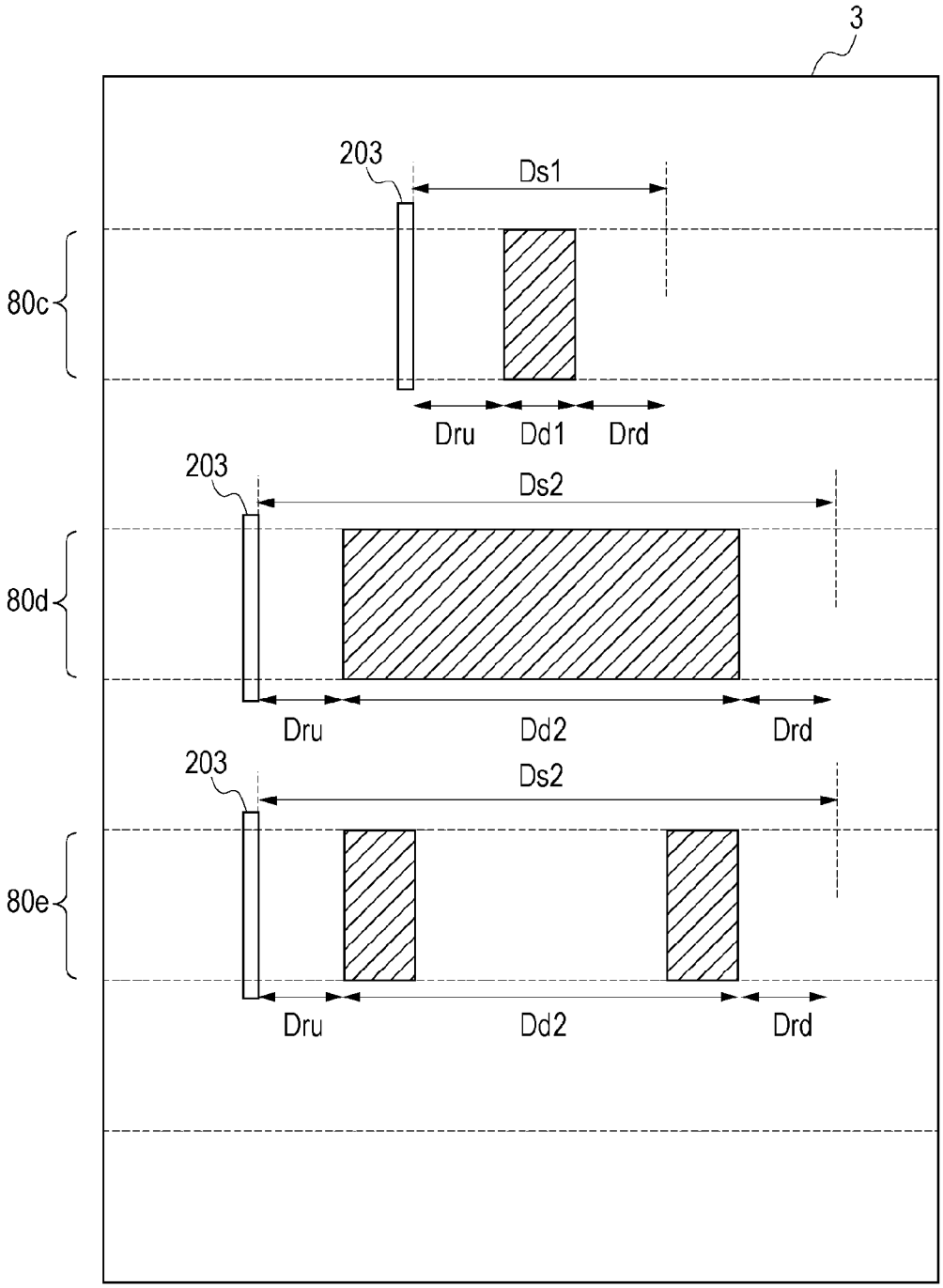
FIG. 16 is a schematic diagram illustrating a scanning area according to an embodiment.

FIG. 16 is a schematic diagram illustrating the scanning area of the recording head 101.

An image with a dimension of a distance Dd1 in the X-direction is recorded in a unit area 80*c* on the recording medium 3. An image with a dimension of a distance Dd2 (Dd2>Dd1) in the X-direction is recorded in a unit area 80*d*. Two images each having the dimension of the distance Dd1 in the X-direction are recorded in a unit area 80*e*. The distance between the upstream end of one of the two images recorded in the unit area 80*e* in the X-direction and the downstream end of the other image in the X-direction of is Dd2.

In this embodiment, in recording on a unit area, recording data corresponding to the unit area is obtained, and the distances Dd1 and Dd2 in the X-direction are calculated on the basis of recording data corresponding to the extreme upstream position in the X-direction and recording data corresponding to the extreme downstream position. A distance Dru for ramping up the recording head 101 and a distance Drd for ramping down the recording head 101 are added to each of the distances Dd1 and Dd2 to determine scanning ranges in which the recording head 101 is moved. The ramp-up distance Dru and the ramp-down distance Drd are constant irrespective of recording data.

For example, a scanning range for the unit area 80*c* is determined to be a distance Ds1 (=Dd1+Dru+Drd), and a scanning range for the unit area 80*d* is determined to be a distance Ds2 (=Dd2+Dru+Drd).

A second recording operation in this embodiment will be described in detail below. For ease of explanation, a case in which monochrome recording data is input will be described.

Figure 17A:
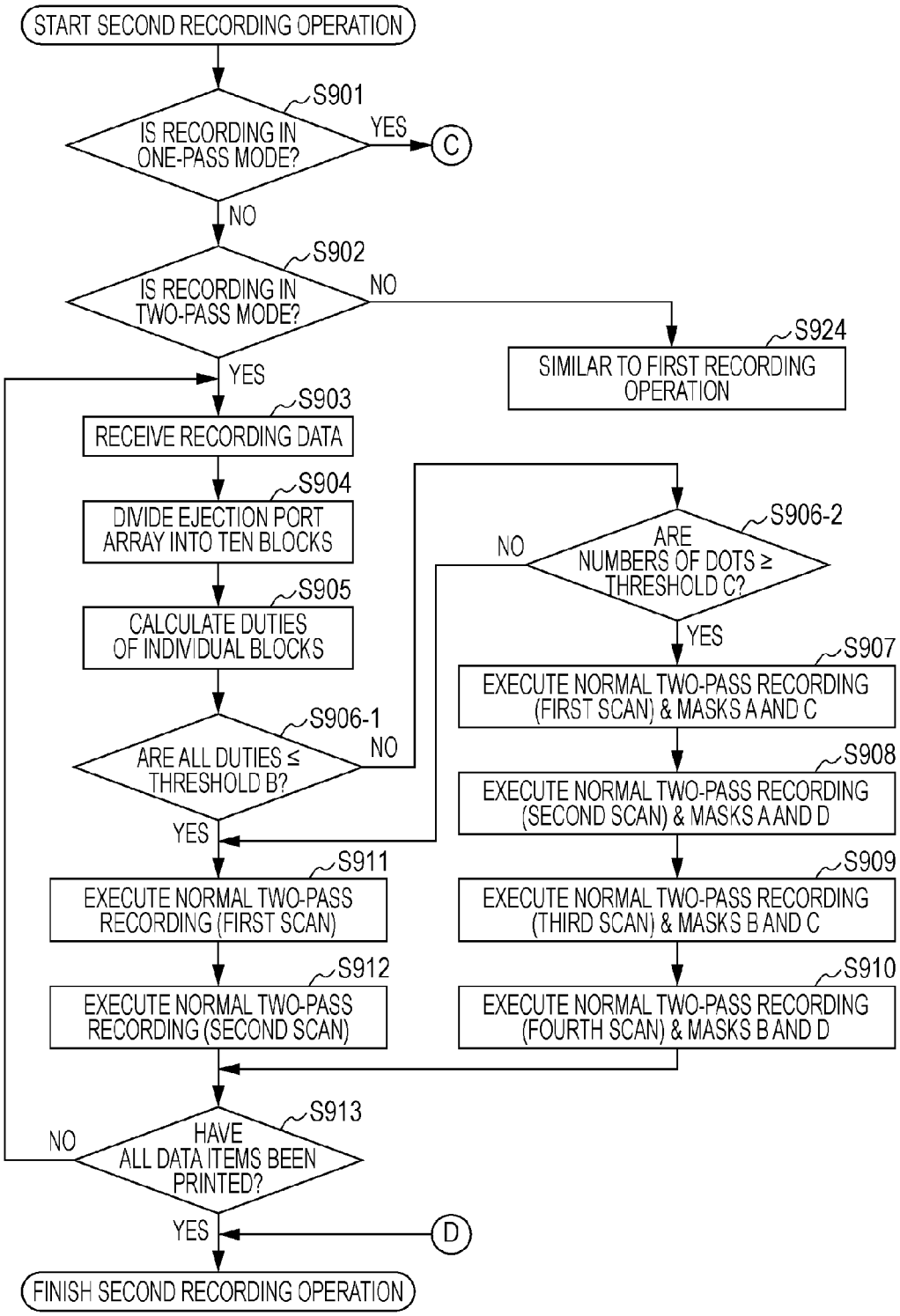
FIG. 17A is a flowchart showing a second recording operation according to an embodiment.
Figure 17B:
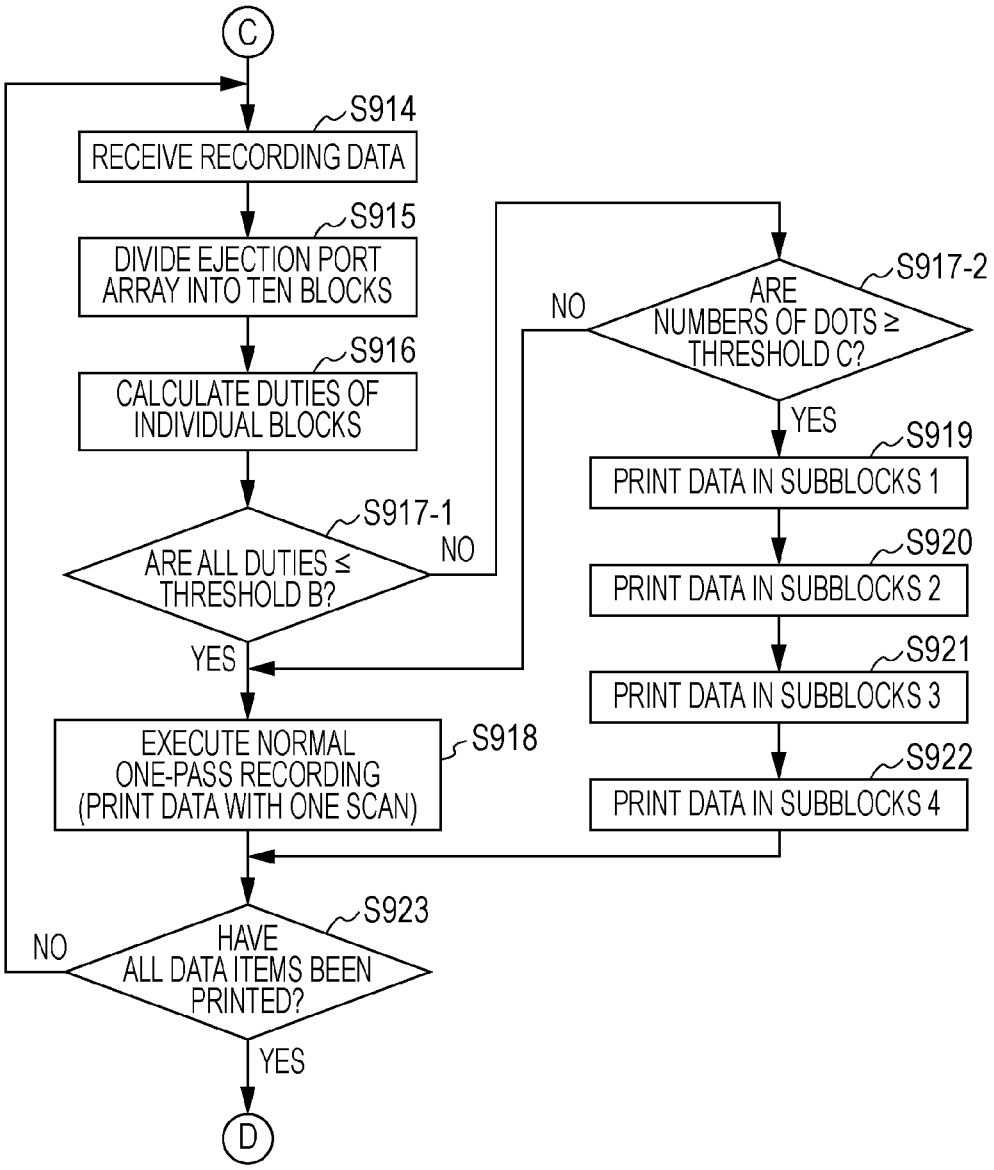
FIG. 17B is a flowchart showing the second recording operation according to an embodiment.

FIGS. 17A and 17B are flowcharts for executing the second recording operation. A program for the flowcharts in FIGS. 17A and 17B is stored in the ROM 304, is written to the RAM 305, and is executed by the MPU 302.

The processes from S901 to S904, S907 to S915, and S918 to S924 shown in FIGS. 17A and 17B are the same as those of S801 to S804, S807 to S815, and S818 to S824 shown in FIG. 11, and descriptions thereof will be omitted.

If at S901 the recording mode is determined to be the one-pass recording mode, the recording duties of the individual blocks are calculated on the basis of the width of the image in the X-direction. Specifically, recording duties Nb' of the individual blocks are calculated using Eq. 2:

$$Nb' = \text{the number of dots in each block} \div (\text{the width of recording data} \times \text{the number of ejection ports}) \div 2 \quad \text{Eq. 2}$$

The width of recording data in Eq. 2 is the distance between, of recording data corresponding to the unit area, recording data corresponding to the extreme upstream position in the X-direction and recording data corresponding to the extreme downstream position. For example, for the image recorded in the unit area 80*c* in FIG. 16, the width of recording data is Dd1, and for the image recorded in the unit area 80*d*, the width of recording data is Dd2.

Next, it is determined whether the recording duties Nb' of all the blocks are equal to or smaller than the threshold value B (a second threshold value) (S917-1). If it is determined that the recording duties Nb' of all the blocks are equal to or smaller than the threshold value B, recording is performed with one scan of the recording head (S918).

If the recording duty Nb' of at least one block is determined to be equal to or higher than the threshold value B, the number of dots recorded in the block in which the recording duty Nb' is high is counted. It is determined whether the numbers of dots in all the blocks with high recording duties Nb' are equal to or higher than a threshold value C (S917-2). In this embodiment, 59,000 dots are determined as the threshold value C.

If at S917-2 it is determined that the number of dots in at least one block is less than the threshold value C, recording is performed with one scan (S918, the first recording mode). In contrast, if it is determined that the numbers of dots in all the blocks are equal to or larger than the threshold value C, recording is executed with four scans (S919 to S922, the second recording mode).

Even if it is determined at S917-1 that the recording duties of all the blocks are higher than the threshold value B, this embodiment performs recording with one scan (the first recording mode) if at S917-2 it is determined that the numbers of dots in the blocks are less than the threshold value C. The reason will be described in detail below.

The scanning width of the carriage 102 is the sum of the recording data width (Dd1 and Dd2) and the ramp-up and ramp-down distances (Dru and Drd) of the recording head 101. Therefore, the scanning time of the recording head 101 for the unit area depends on the recording data. Since the ramp-up and ramp-down times are constant irrespective of the recording data, the ratio of the ramp-up and ramp-down times to the scanning time depends on the recording data. In other words, with a pattern having a small recording data width, the ratio of the ramp-up and ramp-down times to the scanning time is large, and for a pattern with a large recording data width, the ratio of the ramp-up and ramp-down times to the scanning time is small. Since ejection for recording is not performed during the ramp-up and ramp-down times, the temperature of the recording head 101 decreases during those times. In other words, with a pattern having a very small recording data width (a ruled pattern), the rise in the temperature of the recording head 101 is small due to a temperature drop during the ramp-up and ramp-down times. Therefore, if only the recording duty is used for determination, even a pattern that needs divided printing is used for divided printed, causing a decrease in throughput. This embodiment therefore uses the threshold value C to prevent unnecessary divided printing. Also at step S906-1 and step S906-2, the same processes as those of step S917-1 and S917-2 are performed.

As described above, this embodiment allows recording in which both an excessive rise in the temperature of the ejection ports and a decrease in throughput are prevented also in the case where the scanning range of the recording head is changed depending on the recording data.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), microprocessor unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the above embodiments, the threshold value B is set at 22%. This is because it is known from experiment that, with the recording apparatus according to the embodiments, a recording duty of 22% or less will cause the maximum temperature of the recording head to be lower than a temperature at which the recording head is damaged. In other words, the recording duty of 22% or less will not cause an excessive rise in the temperature of the ejection ports even if idle ejection occurs. The threshold value B may be changed as appropriate depending on the recording apparatus.

In the above embodiments, both the Bk chip and the Cl chip are provided with temperature sensors. The values of the temperature sensors are always monitored, and if the output values exceed a predetermined value, the recording operation is stopped. If a local temperature rise occurs at a position far from the temperature sensors, that is, in the vicinity of the center of the Bk ejection port array 203, it takes much time until the heat reaches the temperature sensor because the Bk ejection port array 203 is long. Therefore, even with the monitoring using the temperature sensor, the recoding head 101 can be damaged. However, for the Cl ejection port array 204, even if a local temperature rise occurs at a position far from the temperature sensor, for example, at the end of the ejection port array opposite to the temperature sensor, the heat propagates fast to the temperature sensor, because the Cl ejection port array 204 is short. Accordingly, damage to the recording head 101 can be prevented only by control of monitoring the output value of the temperature sensor. For this reason, the control according to the embodiments is applied only to the Bk ejection port array 203. It is to be understood that the control may be applied to the Cl ejection port array 204.

An apparatus and a method of ink-jet recording and a non-transitory computer-readable storage medium according to embodiments of the present invention allow recording in which an ink ejection failure due to an excessive rise in the temperature of ejection ports is prevented while preventing a decrease in throughput.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170985, filed Aug. 25, 2014, which is hereby incorporated by reference herein in its entirety.

What is claimed is:

1. An ink-jet recording apparatus comprising:

a recording head including a recording element array in which a plurality of recording elements that generate energy for use in ejecting ink are arrayed in a predetermined direction;

a scanning unit configured to cause the recording head to scan relatively over a recording medium in a scanning direction intersecting the predetermined direction;

a first acquisition unit configured to acquire information regarding a cumulative total of an ejection amount of ink;

a second acquisition unit configured to acquire information regarding an ejection amount of ink during scanning for recording on a unit area of the recording medium;

a selection unit configured to select, on the basis of the information acquired by the first acquisition unit and the information acquired by the second acquisition unit, one recording mode from a plurality of recording modes including at least a first recording mode, a second recording mode and a third recording mode, the first recording mode being for recording an image on the unit area with M scans of the recording head performed by the scanning unit, and the second recording mode being for recording an image on the unit area with N (N>M) scans of the recording head performed by the scanning unit, wherein a number of times that at least one of the plurality of recording elements is driven during one scan of the recording head is limited, and the third recording mode being for recording an image on the unit area with L (M<L<N) scans of the recording head performed by the scanning unit, wherein a number of times that at least one of the plurality of recording elements is driven during one scan of the recording head is limited; and a recording unit configured to record an image on the unit area by driving the plurality of recording elements according to a recording mode selected by the selection unit and ejecting ink from the recording head, wherein the selection unit (i) selects the first recording mode in a case where the cumulative total indicated by the information acquired by the first acquisition unit is smaller than a predetermined cumulative total and the ejection amount indicated by the information acquired by the second acquisition unit is smaller than a first ejection amount;

(ii) selects the third recording mode in a case where the cumulative total indicated by the information acquired by the first acquisition unit is smaller than the predetermined cumulative total and the ejection amount indicated by the information acquired by the second acquisition unit is larger than the first ejection amount;

(iii) selects the first recording mode in a case where the cumulative total indicated by the information acquired by the first acquisition unit is larger than the predetermined cumulative total and the ejection amount indicated by the information acquired by the second acquisition unit is smaller than a second ejection amount; and (iv) selects the second recording mode in a case where the cumulative total indicated by the information acquired by the first acquisition unit is larger than the predetermined cumulative total, and the ejection amount indicated by the information acquired by the second acquisition unit is larger than the second ejection amount.

2. The ink-jet recording apparatus according to claim 1, further comprising:

a third acquisition unit configured to acquire information regarding the number of dots recorded in a range in which the image is recorded in the unit area in the scanning direction, wherein the selection unit (iv-1) selects the first recording mode in a case where the cumulative total indicated by the information acquired by the first acquisition unit is larger than the predetermined cumulative total, the ejection amount indicated by the information acquired by the second acquisition unit is larger than the second ejection amount, and the number of dots indicated by the information acquired by the third acquisition unit is smaller than a first number, and (iv-2) selects the second recording mode in a case where the cumulative total indicated by the information acquired by the first acquisition unit is larger than the predetermined cumulative total, the ejection amount indicated by the information acquired by the second acquisition unit is equal to or larger than the second ejection amount, and the number of dots indicated by the information acquired by the third acquisition unit is larger than the first number.

3. The ink-jet recording apparatus according to claim 1, wherein the recording element array is divided into a plurality of recording element group each including a plurality of recording elements continuously arrayed in the predetermined direction, each of the plurality of recording element groups is divided into N recording element units each including a plurality of recording elements; and the second recording mode is a recording mode for ejecting ink to record an image by driving one of the N recording element units in each of the N scans of the recording head.

4. The ink-jet recording apparatus according to claim 3, wherein the second acquisition unit acquires information regarding a maximum value of the ejection amounts of ink for each of the plurality of recording element groups as the information regarding the ejection amount of ink; and the selection unit (iii) selects the first recording mode in a case where the cumulative total indicated by the information acquired by the first acquisition unit is larger than the predetermined cumulative total and the maximum value by the information acquired by the second acquisition unit, is smaller than the second ejection amount, and (iv) selects the second recording mode in a case where the cumulative total indicated by the information acquired by the first acquisition unit is larger than the predetermined cumulative total, and the maximum value indicated by the information acquired by the second acquisition unit is larger than the second ejection amount.

5. The ink-jet recording apparatus according to claim 1, wherein M=1, N=4, and L=2.

6. The ink-jet recording apparatus according to claim 1, further comprising a conveying unit configured to convey the recording medium in a direction intersecting the scanning direction after recording on the unit area is performed.

7. The ink-jet recording apparatus according to claim 6, wherein in the second recording mode an image is recorded with the N scans of the recording head performed by the scanning unit without the recording medium conveyed by the conveying unit.

8. The ink-jet recording apparatus according to claim 1, further comprising:

a detecting unit configured to detect an amount of remaining ink in the recording head, wherein the first acquisition unit acquires information on a cumulative total of ejection amounts of ink in a plurality of scans from a scan in which the amount of remaining ink detected by the detecting unit is less than a predetermined amount to a scan immediately before a scan of the unit area.

9. The ink-jet recording apparatus according to claim 2, wherein the scanning unit causes the recording head to scan on a predetermined area which is a part of the unit area, the predetermined area being comprised of an image area where the image is recorded and an area near to the image area.

10. The ink-jet recording apparatus according to claim 1, wherein the number of times that at least one of the plurality of recording elements is driven during one scan of the recording head in the second recording mode is less than the number of times that at least one of the plurality of recording elements is driven during one scan of the recording head in the third recording mode.

11. The ink-jet recording apparatus according to claim 1, wherein a number of times that at least one of the plurality of recording elements is driven during one scan of the recording head is not limited in the first recording mode.

12. A method of ink-jet recording for recording an image using a recording head including a recording element array in which a plurality of recording elements that generates energy for use in ejecting ink are arrayed in a predetermined direction, the method comprising:

a scanning step of causing the recording head to scan relatively over a recording medium in a scanning direction intersecting the predetermined direction;

a first acquisition step of acquiring information regarding a cumulative total of an ejection amount of ink;

a second acquisition step of acquiring information regarding an ejection amount of ink during scanning for recording on a unit area of the recording medium;

a selection step of selecting, on the basis of the information acquired in the first acquisition step and the information acquired in the second acquisition step, one recording mode from a plurality of recording modes including at least a first recording mode, a second recording mode and a third recording mode, the first recording mode being for recording an image on the unit area with M scans of the recording head performed in the scanning step, and the second recording mode being for recording an image on the unit area with N (N>M) scans of the recording head performed in the scanning step wherein a number of times that at least one of the plurality of recording elements is driven during one scan of the recording head is limited, and the third recording mode being for recording an image on the unit area with L (M<L<N) scans of the recording head performed in the scanning step while wherein a number of times that at least one of the plurality of recording elements is driven during one scan of the recording head is limited; and a recording step of recording an image on the unit area by driving the plurality of recording elements according to a recording mode selected in the selection step and ejecting ink from the recording head, wherein the selection step includes (i) selecting the first recording mode in a case where the cumulative total indicated by the information acquired in the first acquisition step is smaller than a predetermined cumulative total and the ejection amount indicated by the information acquired in the second acquisition step is smaller than a first ejection amount;

(ii) selecting the third recording mode in a case where the cumulative total indicated by the information acquired in the first acquisition step is smaller than the predetermined cumulative total and the ejection amount indicated by the information acquired in the second acquisition step is larger than the first ejection amount;

(iii) selecting the first recording mode in a case where the cumulative total indicated by the information acquired in the first acquisition step is larger than the predetermined cumulative total, and the ejection amount indicated by the information acquired in the second acquisition step is smaller than a second ejection amount; and (iv) selecting the second recording mode in a case where the cumulative total indicated by the information acquired in the first acquisition step is larger than the predetermined cumulative total, and the ejection amount indicated by the information acquired in the second acquisition step is larger than the second ejection amount.

13. A non-transitory computer-readable storage medium storing a program that causes a computer to execute the method of ink-jet recording according to claim 12.

14. An ink-jet recording apparatus comprising:

a recording head including a recording element array in which a plurality of recording elements that generate energy for use in ejecting ink are arrayed in a predetermined direction;

a scanning unit configured to cause the recording head to scan relatively over a recording medium in a scanning direction intersecting the predetermined direction;

a first acquisition unit configured to acquire information regarding a cumulative total of an ejection amount of ink;

a second acquisition unit configured to acquire information regarding an ejection amount of ink during scanning for recording on a unit area of the recording medium;

a third acquisition unit configured to acquire information regarding the number of dots recorded in a range in which the image is recorded in the unit area in the scanning direction, a selection unit configured to select, on the basis of the information acquired by the first acquisition unit and the information acquired by the second acquisition unit, one recording mode from a plurality of recording modes including at least a first recording mode and a second recording mode, the first recording mode being for recording an image on the unit area with M scans of the recording head performed by the scanning unit, and the second recording mode being for recording an image on the unit area with N (N>M) scans of the recording head performed by the scanning unit wherein a number of times that at least one of the plurality of recording elements is driven during one scan of the recording head is limited: and a recording unit configured to record an image on the unit area by driving the plurality of recording elements according to a recording mode selected by the selection unit and ejecting ink from the recording head, wherein the selection unit (i) selects the first recording mode in a case where the cumulative total indicated by the information acquired by the first acquisition unit is larger than the predetermined cumulative total and the ejection amount indicated by the information acquired by the second acquisition unit is smaller than a predetermined ejection amount;

(ii) selects the first recording mode in a case where the cumulative total indicated by the information acquired by the first acquisition unit is larger than the predetermined cumulative total, the ejection amount indicated by the information acquired by the second acquisition unit is larger than the predetermined ejection amount, and the number of dots indicated by the information acquired by the third acquisition unit is smaller than a first number; and (iii) selects the second recording mode in a case where the cumulative total indicated by the information acquired by the first acquisition unit is larger than the predetermined cumulative total, the ejection amount indicated by the information acquired by the second acquisition unit is larger than the predetermined ejection amount, and the number of dots indicated by the information acquired by the third acquisition unit is larger than the first number.

15. The ink-jet recording apparatus according to claim 14, wherein the scanning unit causes the recording head to scan on a predetermined area which is a part of the unit area, the predetermined area being comprised of an image area where the image is recorded and an area near to the image area.

16. An ink-jet recording apparatus comprising:

a recording head including a recording element array in which a plurality of recording elements that generate energy for use in ejecting ink are arrayed in a predetermined direction, the recording element array being divided into a plurality of recording element group each including a plurality of recording elements continuously arrayed in the predetermined direction, each of the plurality of recording element groups being divided into N recording element units each including a plurality of recording elements;

a scanning unit configured to cause the recording head to scan relatively over a recording medium in a scanning direction intersecting the predetermined direction;

a first acquisition unit configured to acquire information regarding a cumulative total of an ejection amount of ink;

a second acquisition unit configured to acquire information regarding a maximum value of the ejection amounts of ink for each of the plurality of recording element groups during scanning for recording on a unit area of the recording medium;

a selection unit configured to select, on the basis of the information acquired by the first acquisition unit and the information acquired by the second acquisition unit, one recording mode from a plurality of recording modes including at least a first recording mode and a second recording mode, the first recording mode being for recording an image on the unit area with M scans of the recording head performed by the scanning unit, and the second recording mode being for recording an image on the unit area with N (N>M) scans of the recording head performed by the scanning unit wherein a number of times that at least one of the plurality of recording elements is driven during one scan of the recording head is limited, by driving one of the N recording element units in each of the N scans of the recording head; and a recording unit configured to record an image on the unit area by driving the plurality of recording elements according to a recording mode selected by the selection unit and ejecting ink from the recording head, wherein the selection unit (i) selects the first recording mode in a case where the cumulative total indicated by the information acquired by the first acquisition unit is larger than the predetermined cumulative total and the maximum value indicated by the information acquired by the second acquisition unit is smaller than a predetermined ejection amount; and (ii) selects the second recording mode in a case where the cumulative total indicated by the information acquired by the first acquisition unit is larger than the predetermined cumulative total and the maximum value indicated by the information acquired by the second acquisition unit is larger than the predetermined ejection amount.

* * * * *